US011261888B1

(12) United States Patent
Davis

(10) Patent No.: US 11,261,888 B1
(45) Date of Patent: Mar. 1, 2022

(54) ISOTHERMAL PUMP WITH IMPROVED CHARACTERISTICS

(71) Applicant: Brian Lee Davis, Ripon, WI (US)

(72) Inventor: Brian Lee Davis, Ripon, WI (US)

( * ) Notice: Subject to any disclaimer, the term of this patent is extended or adjusted under 35 U.S.C. 154(b) by 55 days.

(21) Appl. No.: 16/703,771

(22) Filed: Dec. 4, 2019

Related U.S. Application Data

(60) Provisional application No. 62/778,449, filed on Dec. 12, 2018.

(51) Int. Cl.
*F15B 21/042* (2019.01)
*F04B 39/06* (2006.01)

(52) U.S. Cl.
CPC ..... *F15B 21/042* (2013.01); *F04B 39/06* (2013.01); *F15B 2211/62* (2013.01)

(58) Field of Classification Search
CPC ..... F15B 21/042; F15B 2211/62; F04B 39/06
See application file for complete search history.

(56) References Cited

U.S. PATENT DOCUMENTS 3,847,182 A 11/1974 Greer
4,446,698 A 5/1984 Benson
4,490,974 A * 1/1985 Colgate ..... F02G 1/04 60/517
4,915,018 A * 4/1990 Scott ..... F16J 3/06 92/98 D
5,275,014 A * 1/1994 Solomon ..... F01L 23/00 417/383
8,171,728 B2 5/2012 Bollinger et al.
8,495,872 B2 7/2013 McBride et al.
8,567,303 B2 10/2013 Ingersoll et al.
8,572,959 B2 11/2013 Ingersoll et al.
9,234,480 B2 1/2016 Gayton
2006/0258999 A1* 11/2006 Ponomarenko ..... A61F 13/8405 604/360
2009/0260361 A1 10/2009 Prueitt
2011/0239640 A1 10/2011 Charlat
2011/0258999 A1 10/2011 Ingersoll et al.
2014/0007569 A1 1/2014 Gayton
2015/0176526 A1 6/2015 Frazier et al.
2016/0281638 A1 9/2016 Holsapple
2016/0341224 A1 11/2016 Lynn et al.

FOREIGN PATENT DOCUMENTS

CN 203603983 * 5/2014

* cited by examiner

*Primary Examiner* — Charles G Freay
(74) *Attorney, Agent, or Firm* — Brannen Law Offices, LLC

(57) ABSTRACT

The pump has a body having a heat sink on the body underside. An extension rises from the body. A guide is provided for a piston, which together move up and down relative to the body and extension. The pump is within a tank filled with heating liquid. The heating liquid is separated (directly or indirectly) from a gas cavity with a bladder. The pump can have a coolant cavity partially bordered by a bladder that separates the heating liquid from the gas. A coolant then flows through the cavity over the top of the bladder keeping it cool and preventing bladder degradation. A high temperature liquid system maintains the temperature of the heating liquid. A coolant system maintains the temperature of the coolant. A pressure equalization system maintains balance in pressure between the heating liquid and coolant. A steam system is provided as is a control system.

12 Claims, 25 Drawing Sheets

FIG. 37
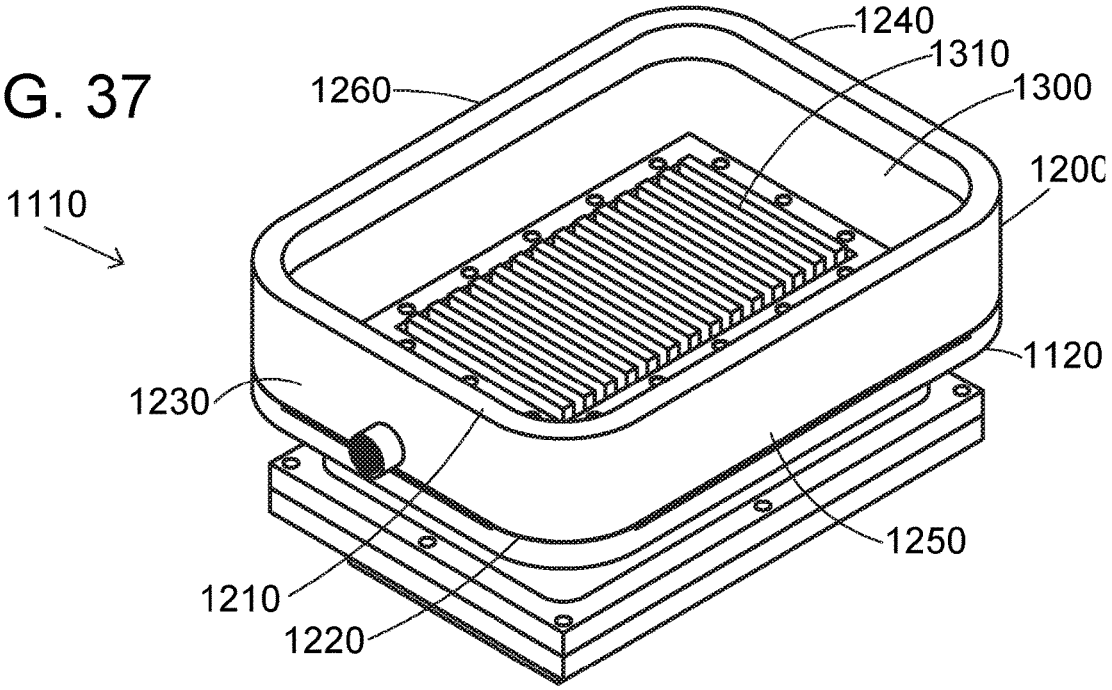
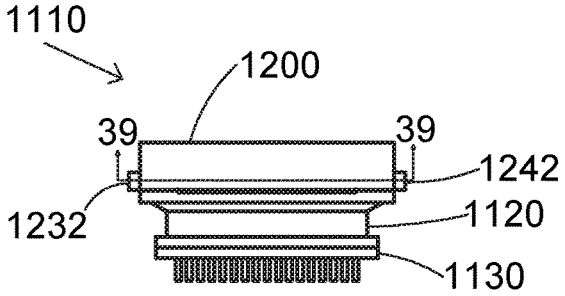
FIG. 38
FIG. 39
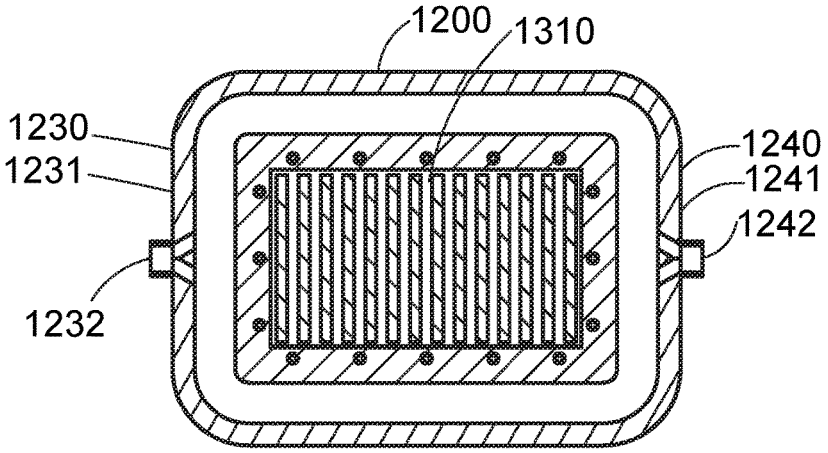

| | p [bar] | t [°C] | v [$m^3$/kg] | h [kj/kg] | s [kj/kg K] | u [kj/kg] | quality |
|---|---|---|---|---|---|---|---|
| 1 (sat liq) | 1.000 | 99.606 | 0.001 | 417.436 | 1.303 | 417.332 | 0.000 |
| 2 (sat liquid) | 39.759 | 250.000 | 0.001 | 1085.687 | 2.793 | 1080.710 | 0.000 |
| 3 (sat vapor) | 39.759 | 250.000 | 0.050 | 2801.012 | 6.072 | 2601.871 | 100.000 |
| 4 (gas) | 1.000 | 250.000 | 2.406 | 2974.537 | 8.035 | 2733.918 | gas |

FIG. 42

| CYCLE A | | Δ U [kj/kg] | Q [kj/kg] | W [kj/kg] |
|---|---|---|---|---|
| pump | 1-2 | 663 | 659 | 4.9 |
| boiler | 2-3 | 1521 | 1715 | -194 |
| isotherm exp | 3-4 | 132 | 1026 | -894 |
| condenser | 4-1 | -2317 | -2557 | 241 |
| | net | 0 | 843 | -843 |
| | Efficiency | | 24.8 | |

FIG. 43

ISOTHERMAL PUMP WITH IMPROVED CHARACTERISTICS

This patent application claims priority on and the benefit of provisional application 62/778,449, filed Dec. 12, 2018, the entire contents of which are hereby incorporated herein by reference.

BACKGROUND OF THE INVENTION

1. Field of the Invention

The present invention relates to an isothermal pump with improved characteristics including a bladder that can be cooled via coolant flowing in a coolant cavity.

2. Description of the Related Art

Pumps have existed for many years. Thermodynamically, there are advantages to having a pump operate isothermally. In an isothermal process, the temperature remains the same. That is, the change in temperature within the system is zero during a change in pressure and volume of a gas. This is accomplished in a pump environment through a heat exchange. One type of heat exchange in a pump environment is a gas to liquid heat exchange. In this regard, the liquid can be used to remove heat from the gas during compression or add heat to the gas during expansion.

Conductive heat transfer and convective heat transfer can both be relevant in a discussion of an isothermal pump.

Conductive heat transfer can be expressed with "Fourier's Law":

$$q=kAdT/s$$

where q=heat transfer (W, J/s)

A=heat transfer area ($m^2$)

k=thermal conductivity of material (W/m K)

dT=temperature gradient–difference–in the material (K)

s=material thickness (m)

The formula for conductive heat transfer expresses the rate that heat moves through a solid. There is an upper limit of the amount of conductive heat transfer (added or removed) that can occur within a particular system within a given time, given the size of compressor or expander, the compressor or expander materials, the temperature difference, and the material thickness. Pressure and pump speed are not variables that affect conductive heat transfer.

The more conductive the metal used within the pump, the greater the heat transfer surface area and the shorter the distance the heat needs to travel from the hot side to the cold side, the greater the conductive heat transfer will be. Therefore, if the distance from point of contact (the point where the hot gas comes in contact with the fin) to the cold side of the pump (outside liquid side) is short, the heat transferred will be great and vice versa.

Convective heat transfer can be expressed with the following equation:

$$q=h_c A\ dT$$

where q=heat transferred per unit time (W)

A=heat transfer area of the surface ($m^2$)

$h_c$=convective heat transfer coefficient of the process ($W/(m^2K)$)

dT=temperature difference between the surface and the bulk liquid (K)

The formula for convective heat transfer expresses the rate that heat can be removed from or added to a gas. In order for heat to be removed from or added to a gas, the gas must be in contact with a surface and there must be a temperature differential between the gas and the solid surface. The larger the surface area and the greater the temperature differential between the gas and the surface area, the more heat that can be removed from or added to the gas. One example of this is the large number of fins that are present in a radiator. The thickness of the metal (the fins) makes little difference in how much heat can be removed from or added to a gas (in contrast to conductive heat transfer), except for being a factor in determining $h_c$. The amount of heat transferred is simply a function of surface area and temperature differential. Pressure and pump speed are not variables that affect convective heat transfer.

The temperature of a gas increases when it is compressed and decreases when it expands. This increasing and decreasing of temperature increases the work required during compression and reduces the work extracted from the system during expansion. During an isothermal process, the temperature of a gas remains constant during both the compression and expansion of a gas, requiring less work be put into the system. Therefore, it is desirable to have an isothermal pump that keeps the temperature of a gas near constant as a gas is compressed or expanded.

In an ideal isothermal pump, an amount of heat Q is removed from the gas that is equal to the amount of heat Q that is produced by the gas during the compression process, keeping the temperature constant. An ideal isothermal pump used for the purpose of expansion adds an amount of heat Q to the gas that is equal to the amount of heat Q that is lost by the gas during the expansion process, again keeping the temperature of the gas constant during the process. Therefore, in an ideal isothermal pump, the temperature of a gas will remain the same during both expansion and compression.

In order for an isothermal pump to maintain near constant temperature of a gas, when used for compression, the interior of the pump will have a large surface area whereby heat Q produced can flow from the gas to the interior walls of the pump via convection. The heat Q can then easily travel through the walls of the pump which can be thin and have a high thermal conductivity. The heat Q can then be quickly swept away from the exterior walls of the pump by a constant temperature liquid. When an isothermal pump is used for expansion, heat Q will flow through the pump in the opposite direction.

It is noted that since there needs to be a temperature differential between the hot side and cold side of any isothermal pump design, there is no such thing as a perfect isothermal process. Yet, the principals of the present invention are nevertheless referred to as isothermal even though from a practical standpoint, the process is technically near isothermal.

Many pumps attempt to incorporate heat exchange into their design in an attempt to achieve a near isothermal process. However, the slower the rate of heat exchange between the interior and exterior of the pump, the slower the pump must operate to remain isothermal making the process less efficient.

When operating as an expansion pump where work is to be extracted from heat, relative high temperatures are desirable during expansion in order to achieve a high thermodynamic efficiency in accordance with Carnot efficiency. Further, it is desirable to have a significant difference in temperature between the heating liquid and the hot gas whereby the heating liquid must be hotter than the gas in order for heat to flow from the heating liquid to the gas thereby allowing for an isothermal expansion of the gas.

Issues arise as a piston moves relative to a housing in that, absent an effective seal, liquid can enter the gas cavity or gas can escape the gas cavity. This is not a desirable operating condition. Further, while a seal can be used, most flexible seals tend to break down at relatively low temperatures. This limits the upper range of heating liquid temperature and by extension the temperature differential between the heating liquid and the gas as the seals cannot exceed their operational temperature limits without degradation. Limiting the temperatures of the heating liquid and the gas negatively effects pump efficiency.

Thus, there exists a need for an isothermal pump that solves these and other problems.

SUMMARY OF THE INVENTION

The pump has a body having a heat sink on the body underside. An extension rises from the body. A guide is provided for a piston, which together move up and down relative to the body and extension. The pump is within a tank filled with heating liquid. The heating liquid is separated (directly or indirectly) from a gas cavity with a bladder. The pump can have a coolant cavity partially bordered by a bladder that separates the heating liquid from the gas. A coolant then flows through the cavity over the top of the bladder keeping it cool and preventing bladder degradation. A high temperature liquid system maintains the temperature of the heating liquid. A coolant system maintains the temperature of the coolant. A pressure equalization system maintains balance in pressure between the heating liquid and coolant. A steam system is provided as is a control system.

According to one advantage of the present invention, the pump operates in a near isothermal manner for increased efficiency.

According to another advantage of the present invention, the pump is fully submerged in a heating liquid. The convective heat transfer coefficient (hc) of a liquid is much greater than the hc of a gas. Therefore, heat Q from the heating liquid can be transferred to the gas within the pump much more rapidly than if the pump were surrounded by air.

According to another advantage of the present invention, work is extracted from the hot gas as the gas expands within the pump cavity. The work is transferred from the pump though the noncompressible heating liquid surrounding the pump to a crank or similar device.

According to another advantage of the present invention, the liquid surrounding the isothermal pump provides both heat transfer capabilities and acts to transfer work from the pump to power a device exterior of the system.

According to a further advantage of the present invention, the extension and guide provide the foundation for a smooth linear movement of the piston.

According to a still further advantage of the present invention, both the piston and the heat sink can optionally have exterior heat transfer fins to provide substantial heat transfer surface area between these respective components and the heating liquid contained in the tank.

According to a still further advantage yet of the present invention, the bladder is a fully effective seal between the liquid and the gas. An exterior perimeter of the bladder can be contained between the body and the extension. An interior perimeter of the bladder can be contained between the guide and the piston. This design provides a hermetically sealed pump eliminating the possibility of liquid (heating liquid or coolant) commingling with the gas.

According to a still further advantage yet of the present invention, the bladder is flexible and can accommodate bending and stretching as the piston moves between Top Dead Center and Bottom Dead Center. At Bottom Dead Center, the bladder can lay flat against a perimeter angled face of the body.

According to a still further advantage yet of the present invention, a coolant system can circulate coolant through a coolant cavity between the bladder, guide and extension. In this regard, the coolant cools the bladder (maintain integrity of the material) allowing for higher temperatures of gas and heating liquid to be used (even temperatures that would otherwise degrade the bladder). The temperature of the heating liquid needs to be greater than the gas temperature so that heat can flow from the heating liquid to the gas during expansion (isothermal). The required difference in temperature (delta T) between the heating liquid and the gas increases as the piston rpms increase (and heat transfer needs increase).

According to a still further advantage yet of the present invention, two angled coolant inlets and two coolant outlets are provided to ensure adequate coolant flow around both sides of the pump. In an alternative embodiment, a single split inlet can be provided to direct coolant flow to both sides of the pump.

According to a still further advantage yet of the present invention, a pressure equalization system is provided having an expansion cylinder with a piston between the high temperature heating liquid and the low temperature coolant. The expansion cylinder piston moves opposite the pump piston to allow coolant to move into and out of the coolant cavity and also for pressure to equalize between the coolant cavity and the tank interior filled with heating liquid.

According to a still further advantage yet of the present invention, a piston and head within the pressure equalization system separates the heating liquid from the coolant thereby eliminating commingling of the two liquids which would reduce efficiency of the system.

According to a still further advantage yet of the present invention, a control system is provided for controlling many system functions such as controlling a burner for a high-pressure gas reservoir, controlling valves, and controlling the temperature of the high temperature heating liquid within the tank.

Other advantages, benefits, and features of the present invention will become apparent to those skilled in the art upon reading the detailed description of the invention and studying the drawings.

BRIEF DESCRIPTION OF THE DRAWINGS

FIG. 37 is a perspective view of an alternative pump design.

FIG. 38 is a side view of the pump design illustrated in FIG. 37.

FIG. 39 is a cross-sectional view taken along line 39-39 in FIG. 38.

FIG. 42 is a chart of data.

FIG. 43 is a chart of data.

DETAILED DESCRIPTION OF PREFERRED EMBODIMENTS

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

Figure 1:
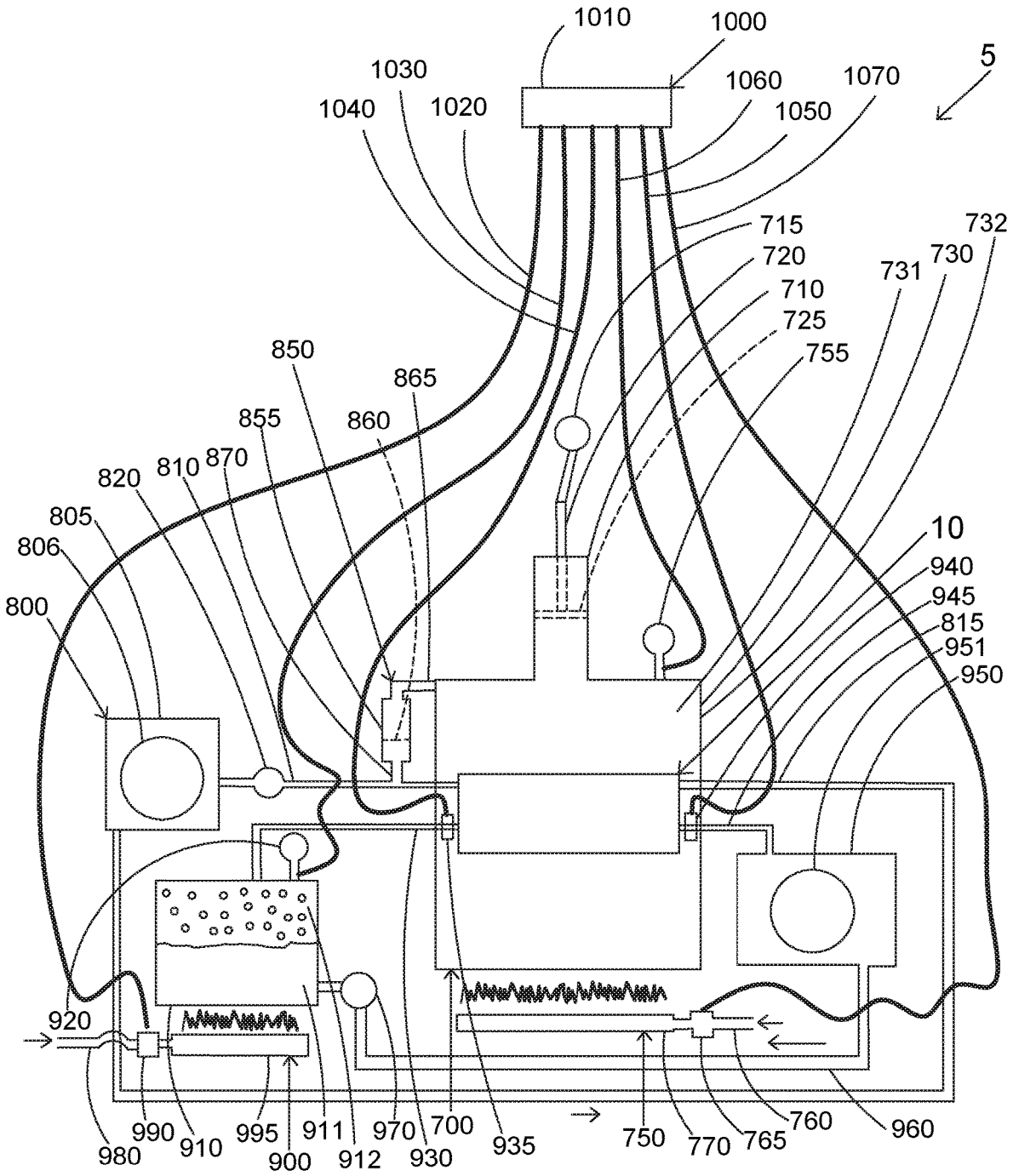
FIG. 1 is a schematic view of a system assembly incorporating an isothermal pump.

A system assembly 5 of the present invention is illustrated in FIG. 1. The system assembly 5 includes a pump 10, a tank 700, a high temperature liquid system 750, a coolant system 800, a pressure equalization system 850, a steam system 900 and a control system 1000. Each of these components are described below.

The pump 10 is shown in FIGS. 2-12. The pump 10 preferably has a body 20, a heat sink 100, an extension 200, a guide 300, a piston 400, and a bladder 500. These components are described below in detail.

The body 20 is seen in isolation in FIGS. 13-16. The body 20 has a top 30 with a perimeter 31 having holes 32 therein and an angled face 33. The body 20 also has a bottom 40 with a perimeter 41 having holes therein. The body 20 further has opposed ends 50 and 60, respectively. End 50 has a wall 51 with a gas inlet 52 therethrough. The gas inlet 52 is preferably in the middle of the wall 51 but can be located elsewhere without departing from the broad aspects of the present invention. End 60 has a wall 61 with a gas outlet 62 therethrough. The gas outlet 62 is preferably in the middle of the wall 61 but can be located elsewhere without departing from the broad aspects of the present invention. The body has sides 70 and 80. Body 20 also has a central opening 90.

Turning now to FIGS. 17-21, it is seen that a heat sink 100 is illustrated. Heat sink 100 has a top 110, a bottom 120, opposed ends 130 and 140 and opposed sides 150 and 160. A central plate 170 is between the top 110 and bottom 120. The central plate 170 has a perimeter 171 with holes 172 passing through the central plate 170 near the perimeter 171. Interior heat transfer fins 180 are located on the top 110 of the heat sink 100. The interior heat transfer fins 180 each have a proximal end 181 and a distal end 182. Each interior heat transfer fin 180 tapers to a point at the distal end 182. In this regard, each interior heat transfer fin 180 is generally triangular shaped. In the illustrated embodiment, there are 31 interior heat transfer fins. However, it is appreciated that there could be more or fewer without departing from the broad aspects of the present invention. The interior heat transfer fins 180 are generally aligned parallel to each other. Exterior heat transfer fins 190 are located on the bottom 120 of the heat sink 100. Each exterior heat transfer fin 190 has a proximal end 191 and a distal end 192. The exterior heat transfer fins preferably have a uniform thickness between respective proximal ends 191 and distal ends 192 and they are preferably parallel to each other. In the illustrated embodiment, there are preferably 17 exterior heat transfer fins. However, it is appreciated that there can be more or fewer without departing from the broad aspects of the present invention. It is appreciated that the interior heat transfer fins 180 are generally aligned perpendicular to the exterior heat transfer fins 190 to provide extra rigidity.

The entire heat sink including the interior and exterior fins can be constructed of a material with a high thermal conductivity such as copper or aluminum. By using a material with high thermal conductivity, heat from the liquid on the exterior of the pump can rapidly flow from the heating liquid to the exterior fins via convection, from the exterior fins to the interior fins via conduction and from the interior fins to the gas on the interior of the pump via convection thereby allowing for an isothermal expansion process. If the pump were to be used for compression, the flow of heat would be reversed.

Turning now to FIGS. 22-25, it is seen that an extension 200 is illustrated. The extension 200 has a top 210. The extension 200 also has a bottom 220. The bottom 220 has several holes therein. An end 230 has a wall 231 with two coolant inlets 232 and 233 there through. An end 240 has a wall 241 with two coolant outlets 242 and 243 there through. Two opposed sides 250 and 260 are provided. The coolant inlets 232 and 233 are preferably angled towards sides 250 and 260 (i.e. diverging), respectively, on the inside of end 230 of the extension 200. The outlets 242 and 243 preferably are angled towards each other (i.e. converging) on the outside of end 240 of the extension 200.

Turning now to FIGS. 26-30, it is seen that a guide 300 is illustrated. The guide 300 has a top 310 with an angled perimeter extension 311. The extension 311 has a proximal end 312 and a distal end 313. The extension further has an upper surface and a bottom surface 314. Guide 300 further has a bottom 320, two ends 330 and 340, and two sides 350 and 360. The guide 300 has a central opening 370. Several holes 380 are formed through the guide 300 interior of a perimeter of the central opening 370.

Turning now to FIGS. 31-35, it is seen that a piston 400 is illustrated. Piston 400 has a top 410, a bottom 420, opposed ends 430 and 440 and opposed sides 450 and 460. A central plate 470 is between the top 410 and bottom 420. The central plate 470 has perimeter holes 471 formed therein from the top 410 that do not pass all the way through the central plate 470. Interior heat transfer fins 480 are located on the bottom 420 of the piston 400. The interior heat transfer fins 480 each have a proximal end 481 and a distal end 482. Each interior heat transfer fin 480 tapers to a point at the distal end 482. In this regard, each interior heat transfer fin 480 is generally triangular shaped. In the illustrated embodiment, there are 30 interior heat transfer fins 480. However, it is appreciated that there could be more or fewer without departing from the broad aspects of the present invention. There are also two end interior heat transfer fins 485 that are trapezoidal in shape (and having parallel respective outer walls). The interior heat transfer fins 480 are generally aligned parallel to each other. Exterior heat transfer fins 490 are located on the top 410 of the piston 400. Each exterior heat transfer fin 490 has a proximal end 491 and a distal end 492. The exterior heat transfer fins preferably have a uniform thickness between their respective proximal ends 491 and distal ends 492 and they are preferably parallel to each other. In the illustrated embodiment, there are preferably 14 exterior heat transfer fins 490. However, it is appreciated that there could be more or fewer without departing from the broad aspects of the present invention. It is appreciated that the interior heat transfer fins 480 are generally aligned perpendicular to the exterior heat transfer fins 490 to provide extra rigidity.

The entire piston including the interior and exterior fins can be constructed of a material with a high thermal conductivity such as copper or aluminum. By using a material with high thermal conductivity, heat from the liquid on the exterior of the pump can rapidly flow from the hot liquid to the exterior fins via convection, from the exterior fins to the interior fins via conduction and from the interior fins to the gas on the interior of the pump via convection thereby allowing for an isothermal expansion process. If the pump were to be used for compression, the flow of heat would be reversed.

Figure 36:
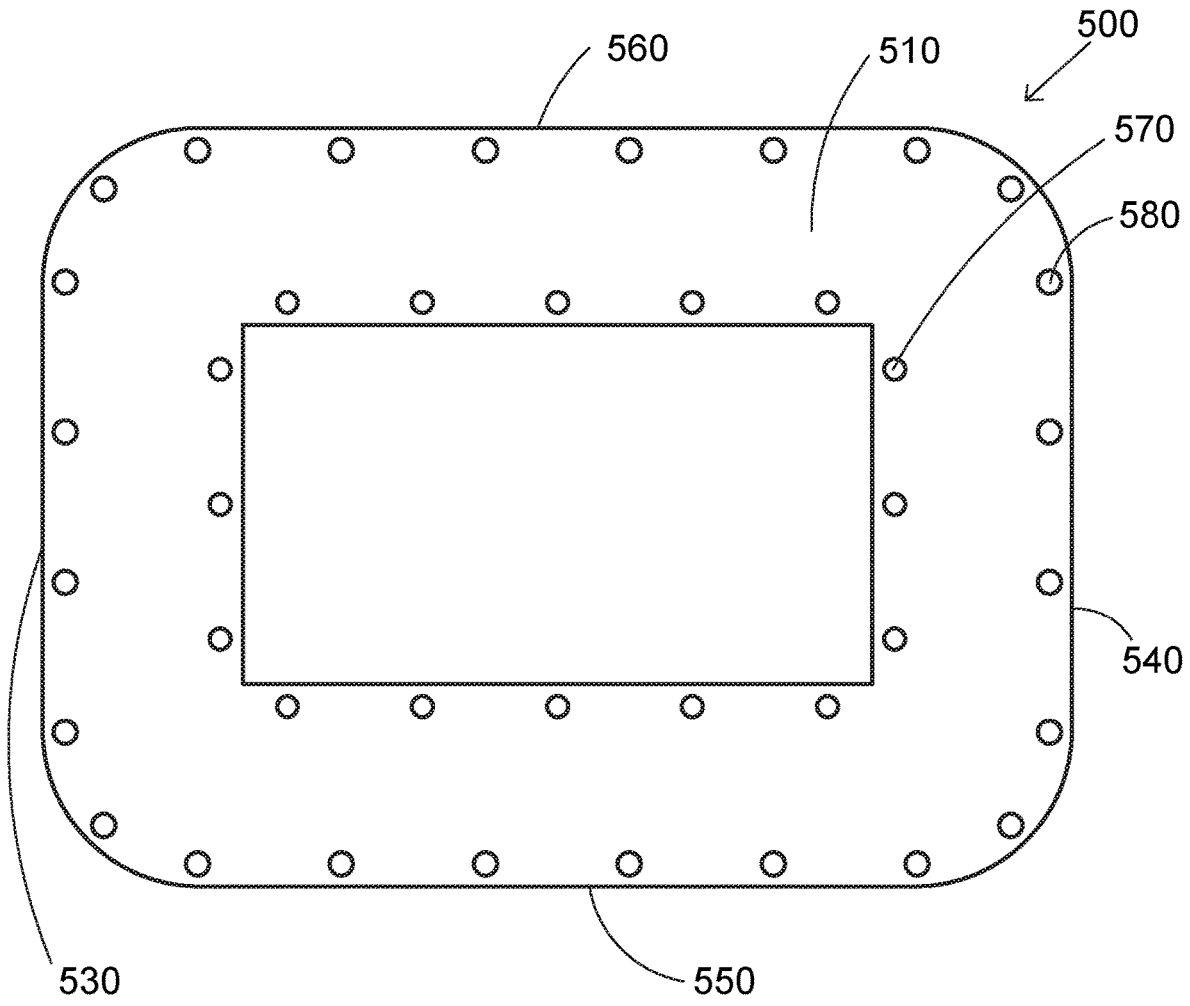
FIG. 36 is a top view of a bladder.

Turning now to FIG. 36, it is seen that an isolation view of the bladder 500 is shown. The bladder 500 has a top 510, bottom 520 (seen in FIG. 2), ends 530 and 540 and sides 550 and 560. There are inner perimeter holes 570 and outer perimeter holes 580 formed through the bladder 500. The bladder 500 is preferably made of a thin (approximately 0.030" thick) flexible high temperature silicone rubber that is medium soft (40 A) to medium (50 A) in hardness. A thin bladder is possible due to the fact that the pressure on the heating liquid side of the bladder will remain nearly equal to the pressure of the gas on the inside of the pump throughout the cycle. Therefore, as pressures are near equal on both sides of the bladder, a thin bladder can withstand very high pressures without tearing. Yet, it is appreciated that other materials can be used without departing from the broad aspects of the present invention.

Returning now to FIGS. 2-12, the relationships of these various components of the pump 10 are illustrated. The heat sink 100 is connected to the bottom 40 of the body 20. Fasteners can be inserted through holes 172 and into holes 42 to secure the heat sink 100 in place forming an airtight seal (preferably with the use of a gasket). The interior heat transfer fins 180 project upwards towards the top 30 of the body 20 through the central opening 90 of the body 20.

Holes 221 of the extension 200, holes 580 of the bladder 500 and holes 32 at the top 30 of the body 20 are aligned and fasteners are inserted therein to secure the extension 200 to the body 20 with the outer perimeter of the bladder 500 secured therebetween.

Holes 471 of the piston 400 are aligned with holes 570 of the bladder 500 and holes 380 of the guide 300 and fasteners are inserted therein to secure the guide 300 to the piston 400 with the inner perimeter of the bladder 500 secured therebetween. The interior heat transfer fins 480 of the piston extends beyond the bottom 320 of the guide 300 through the central opening 370 of the guide 300.

By having the exterior of the bladder 500 squeezed between the body 20 and the extension 200, and the interior of the bladder being squeezed between the piston 400 and the guide 300, the bladder effectively forms an impenetrable surface separating the gas from the coolant. Thus, the entire pump is hermetically sealed separating the gas within the interior of the pump from any exterior liquid.

The angled perimeter extension 311 of the guide 300 can glide closely against the interior walls of the extension 200 so that the piston 400 reciprocates in a smooth linear manner with respect to the heat sink 100 while allowing for a very minimal amount of the heating liquid to commingle with the coolant. Further, interior heat transfer fins 480 of the piston 400 fully mesh with interior heat transfer fins 180 of the heat sink 100 at Bottom Dead Center to minimize gas volume within a gas or steam cavity 600.

The pump 10 has both a gas cavity 600 in which the gas expands in and a coolant cavity 650. Coolant flows through the coolant cavity 650, which is bound by the bladder 500, the bottom surface 314 of the guide 400 and the inside walls of the extension 200. By having a coolant constantly flowing over the top of the bladder 500, the bladder can maintain its structural integrity as the pump operates at a much higher temperature. When the pump operates at a higher temperature a much higher Carnot efficiency can be achieved.

Returning to FIG. 1, the tank 700 has a top section 710. Crank 715 is operable with a piston arm 720 connected to a head 725 that can move in a reciprocating linear manner within the top section 710. The tank has a body 730 with an interior 731 and an exterior 732. The pump 20 is housed within the body 730 of the tank 700.

The high temperature liquid system 750 has a temperature gauge 755 (to measure temperature of heating liquid within tank 700), a gas inlet line 760, a gas valve 765 and a burner 770. The burner 770 is preferably located below the tank body 730 and is used to add heat to the tank to keep the heating liquid in the tank 700 at the desired temperature.

The coolant system 800 has a heat exchanger 805 with a fan 806, an inlet line 810, an outlet line 815, and a coolant pump 820. The inlet line 810 is connected to coolant inlets 232 and 233 of the extension 200. The outlet line 815 is connected to coolant outlets 242 and 243 of the extension 200. The heat exchanger 805 is used to remove any heat absorbed into the coolant during operation of the pump 10. By having coolant liquid enter the coolant cavity 650 through inlets 232 and 233 and exit the coolant cavity through outlets 242 and 243, the bladder is evenly cooled during the expansion process.

Figure 2:
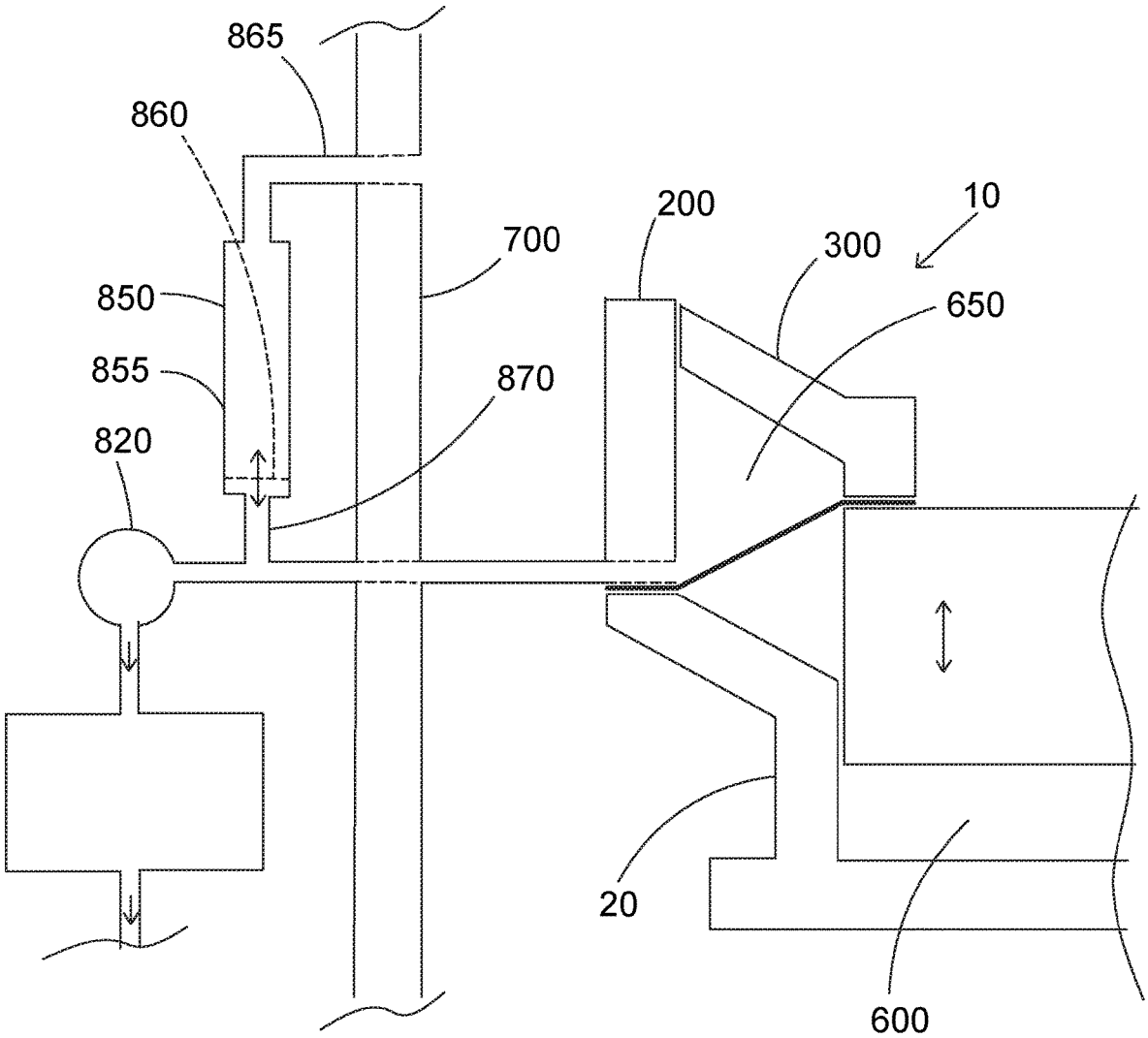
FIG. 2 is a close-up partial schematic view of a pressure equalization piston at Top Dead Center.
Figure 2A:
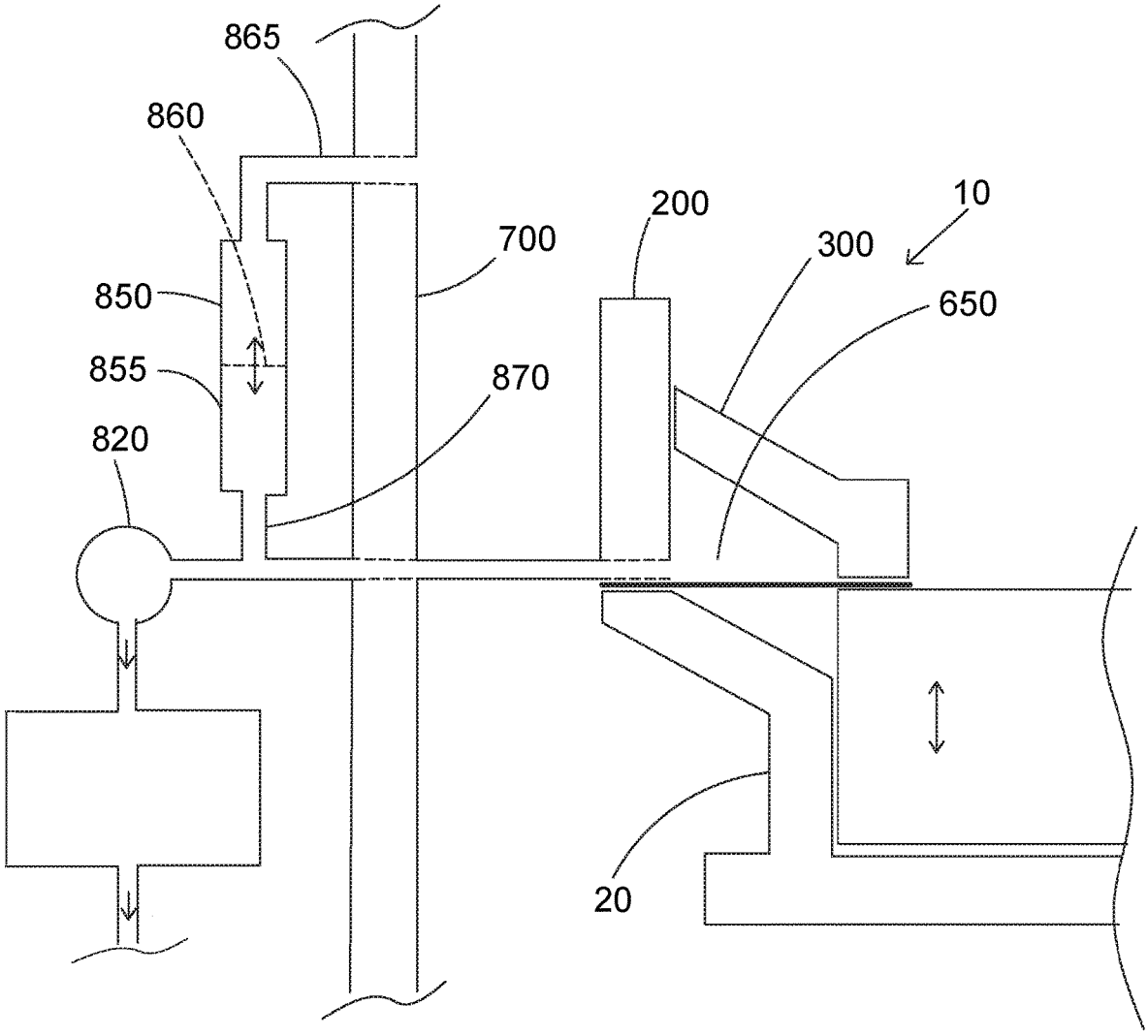
FIG. 2A is similar to FIG. 2, but instead shows the pressure equalization piston between Top Dead Center and Bottom Dead Center.
Figure 2B:
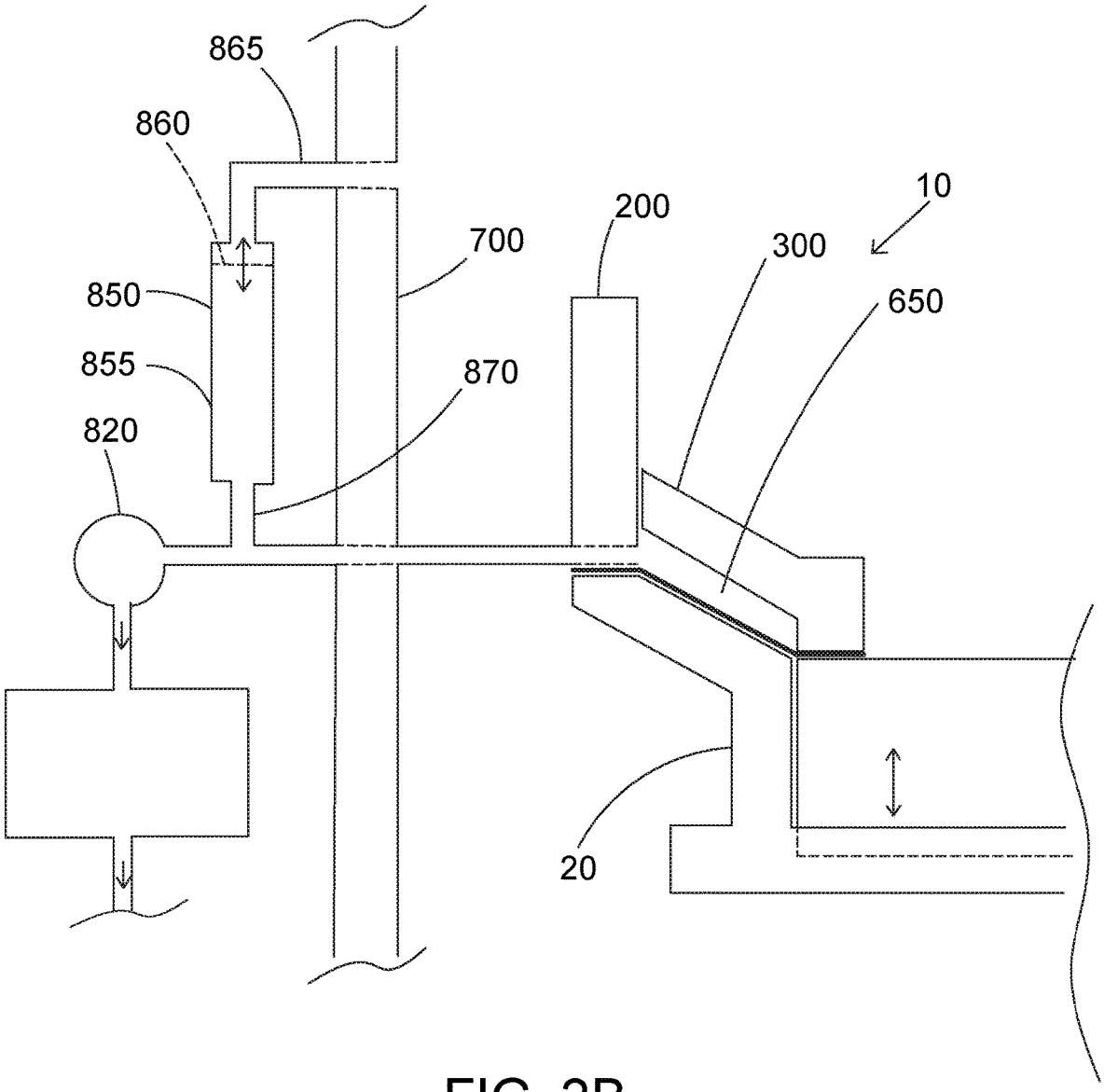
FIG. 2B is similar to FIGS. 2 and 2A, but instead shows the pressure equalization piston at Bottom Dead Center.
Figure 3:
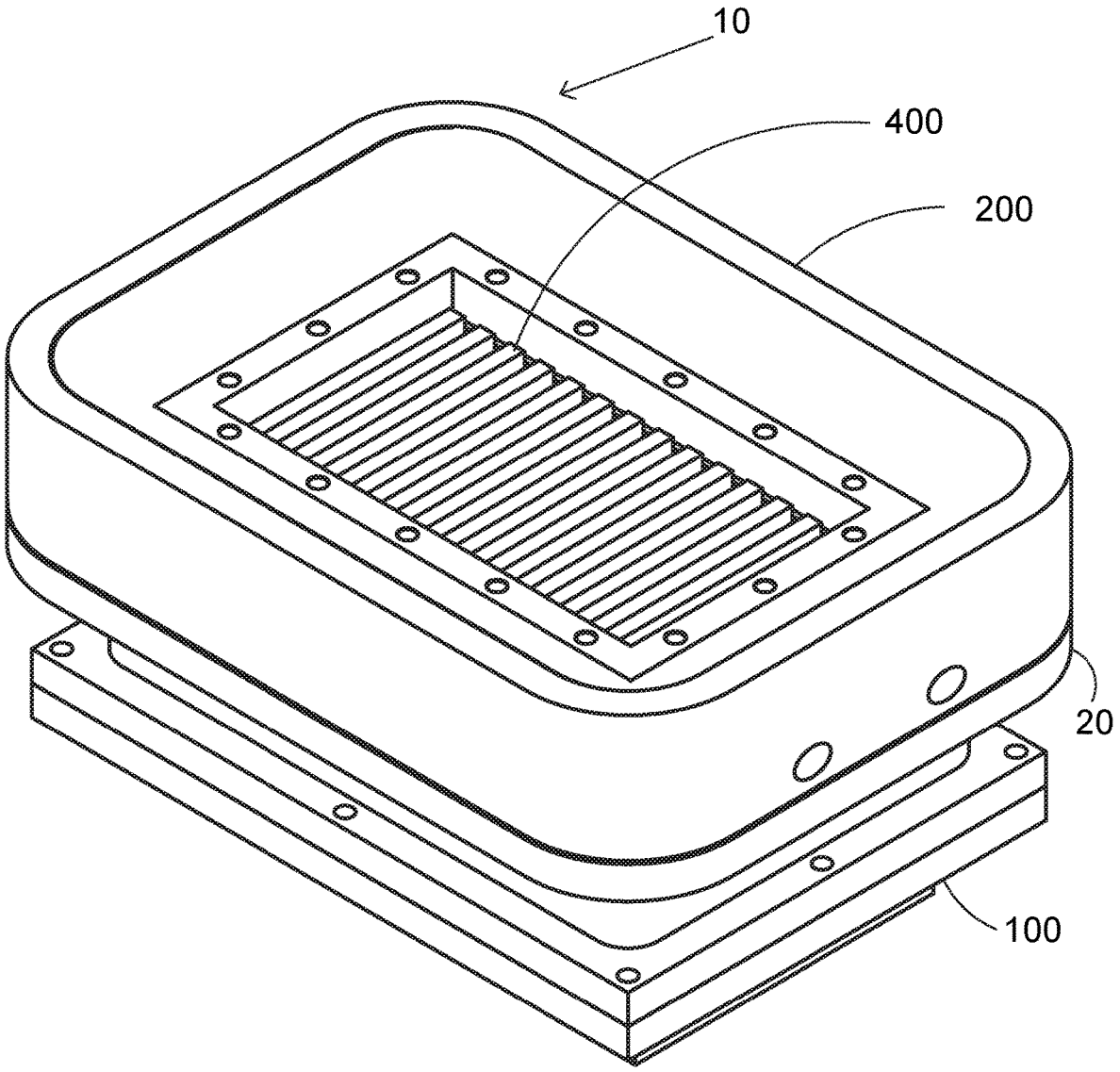
FIG. 3 is a perspective view of an isothermal pump.
Figure 4:
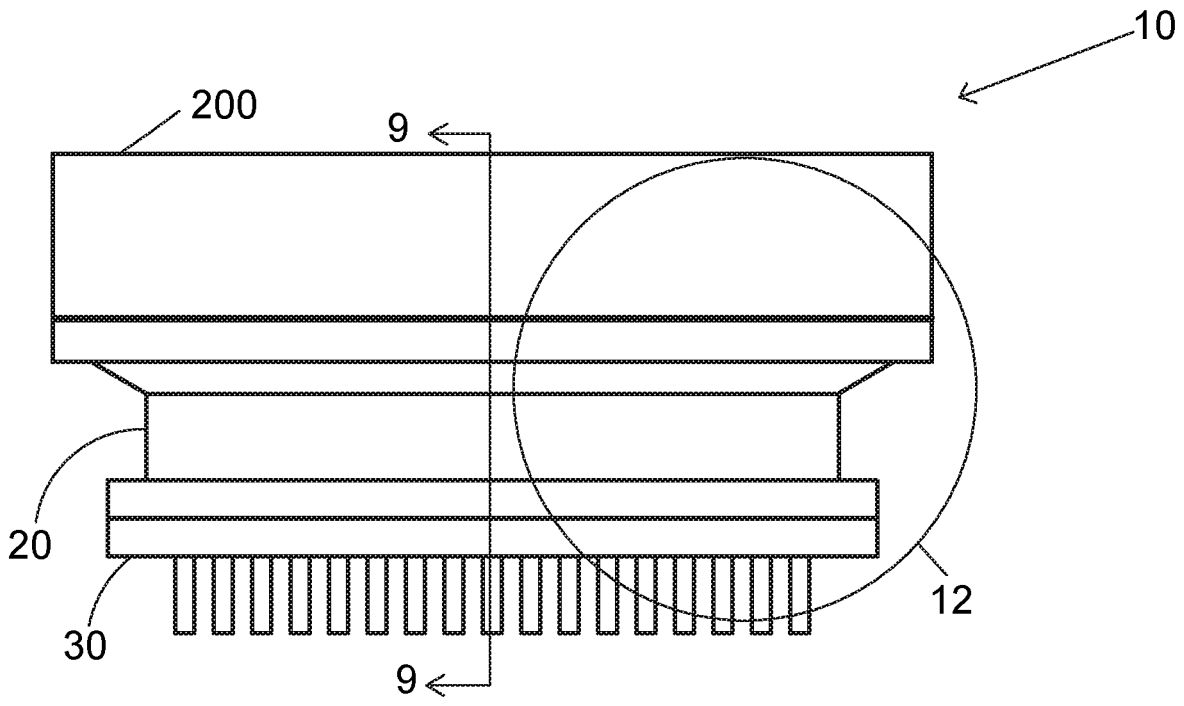
FIG. 4 is a side view of the isothermal pump illustrated in FIG. 3.
Figure 5:
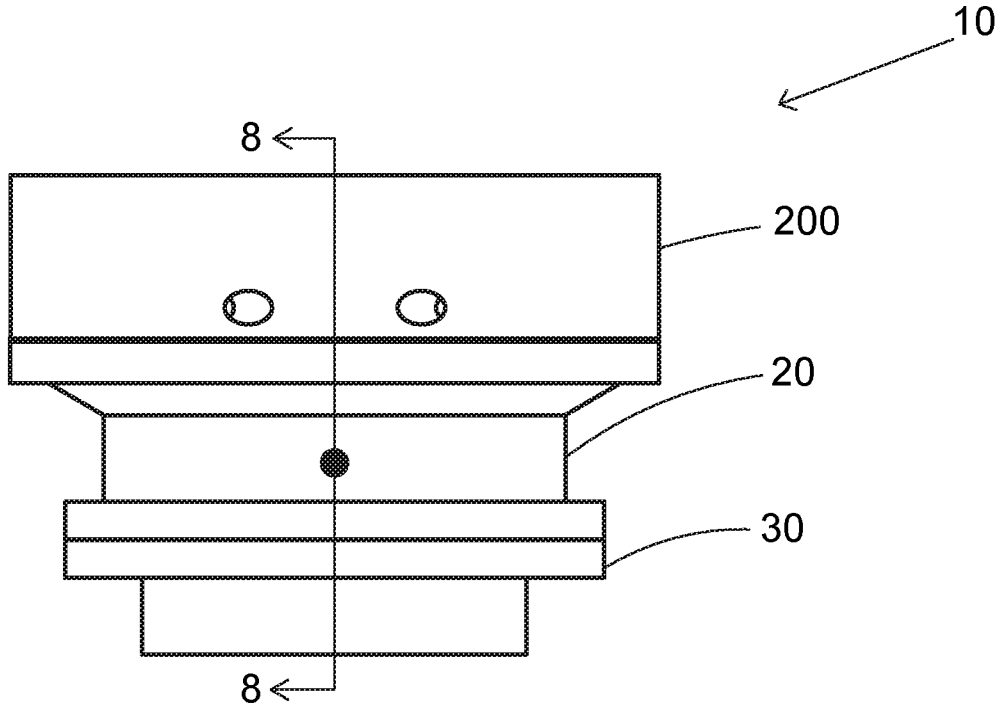
FIG. 5 is an end view of the isothermal pump illustrated in FIG. 3.
Figure 6:
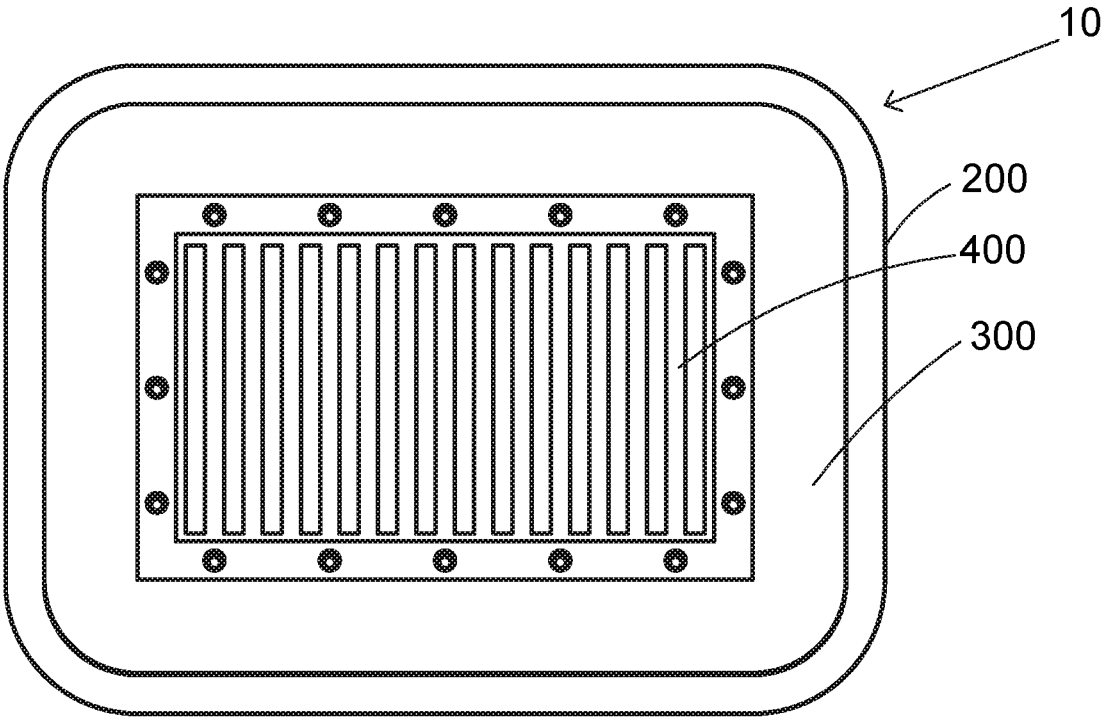
FIG. 6 is a top view of the isothermal pump illustrated in FIG. 3.
Figure 7:
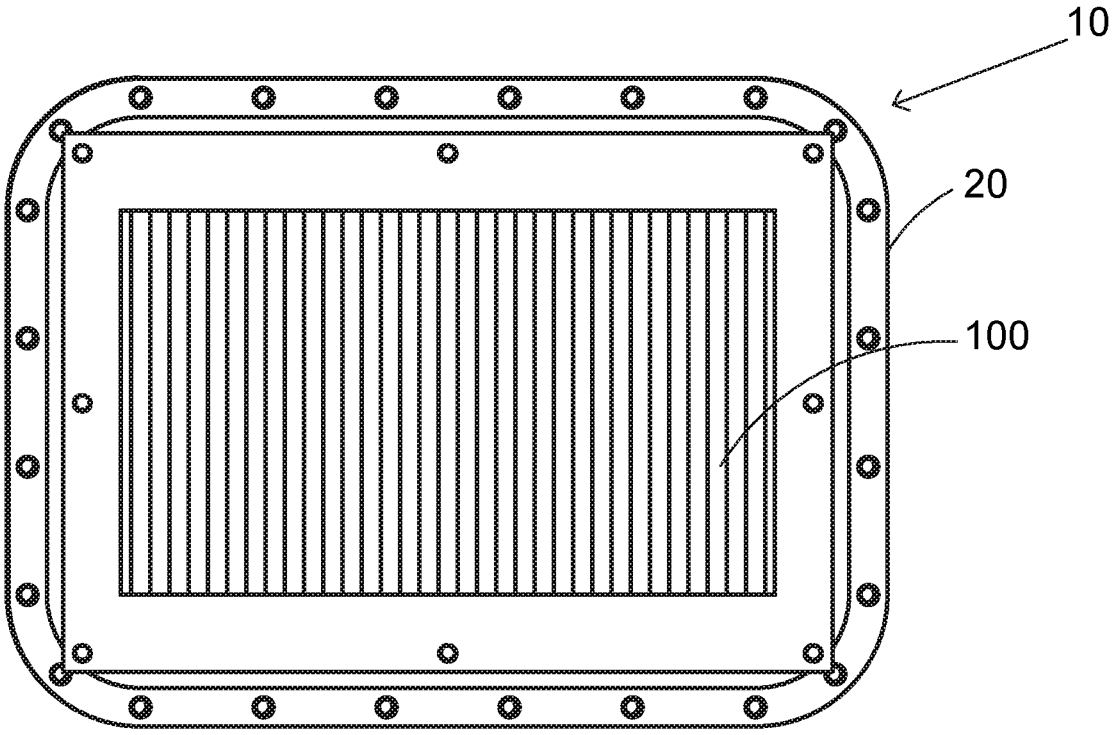
FIG. 7 is a bottom view of the isothermal pump illustrated in FIG. 3.
Figure 8:
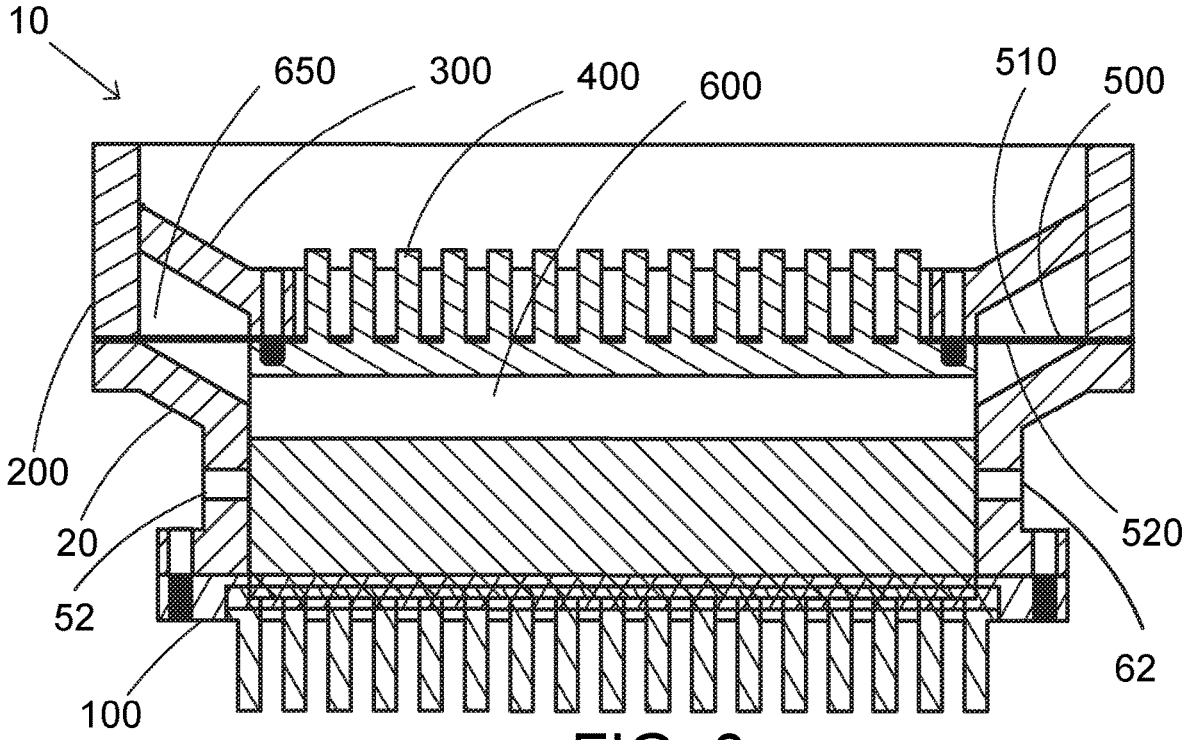
FIG. 8 is a cross-sectional view taken along line 8-8 in FIG. 5.
Figure 9:
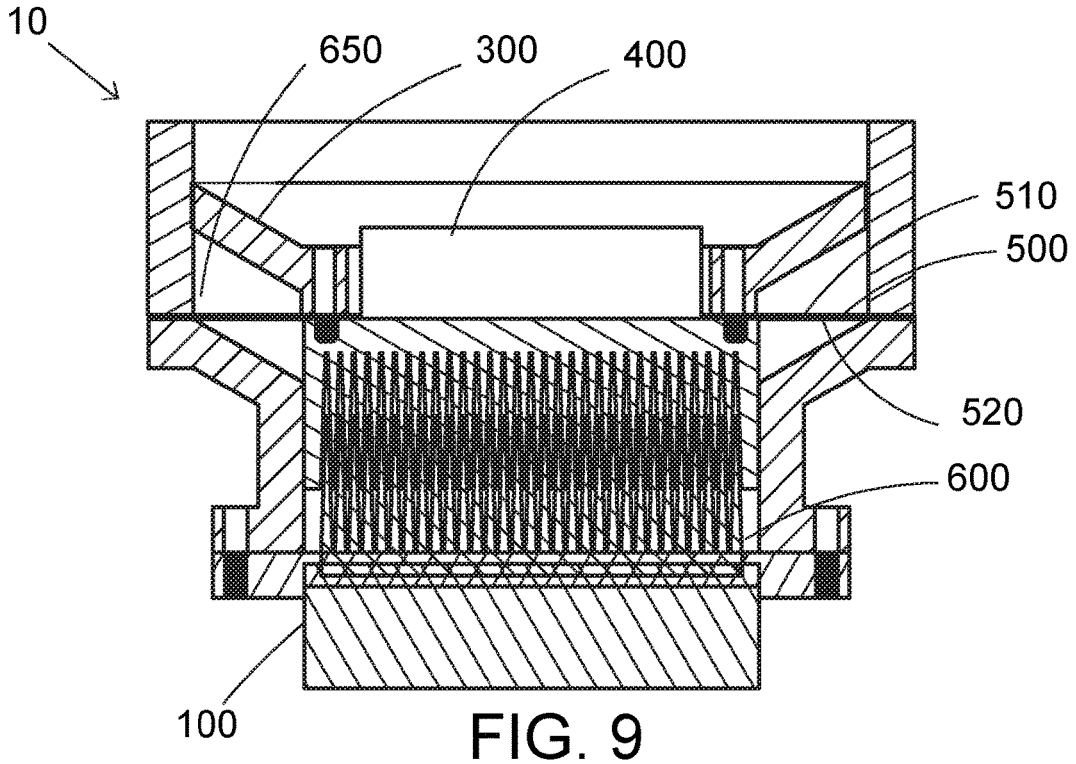
FIG. 9 is a cross-sectional view taken along line 9-9 in FIG. 4.
Figure 10:
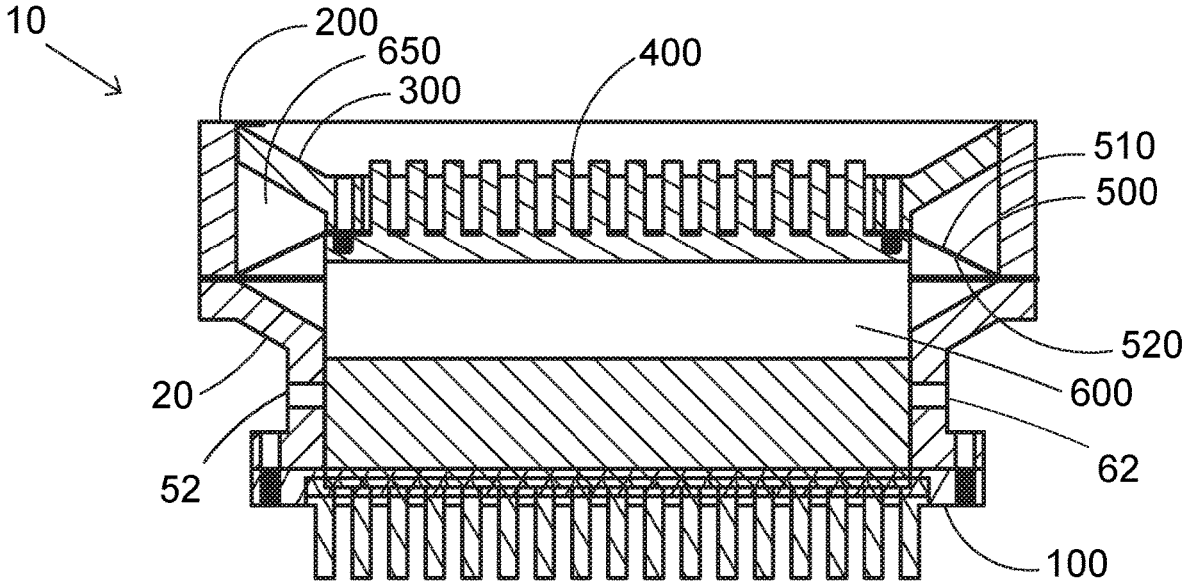
FIG. 10 is similar to FIG. 8 but shows the piston at Top Dead Center.
Figure 11:
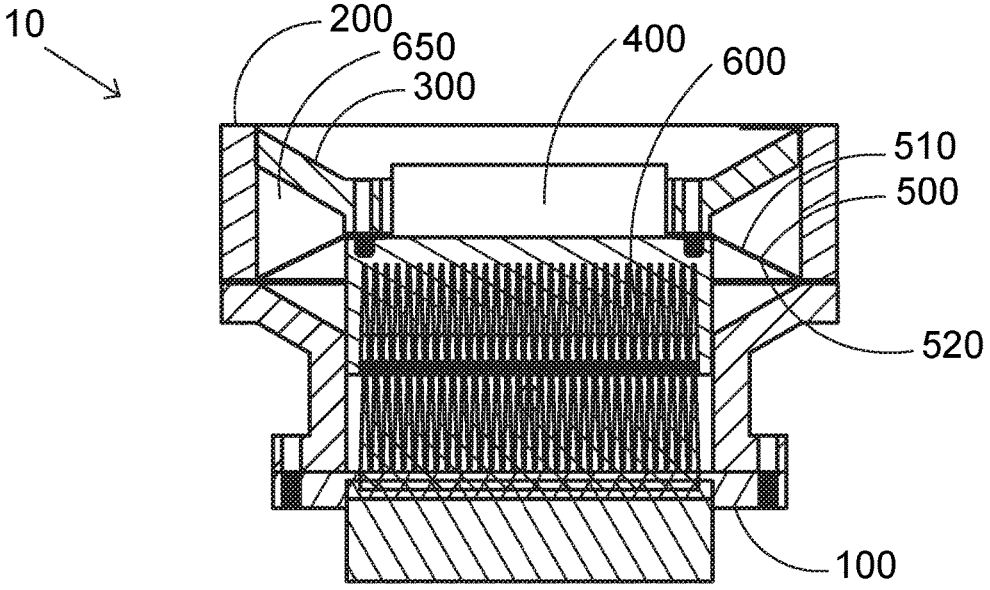
FIG. 11 is similar to FIG. 9 but shows the piston at Top Dead Center.
Figure 12:
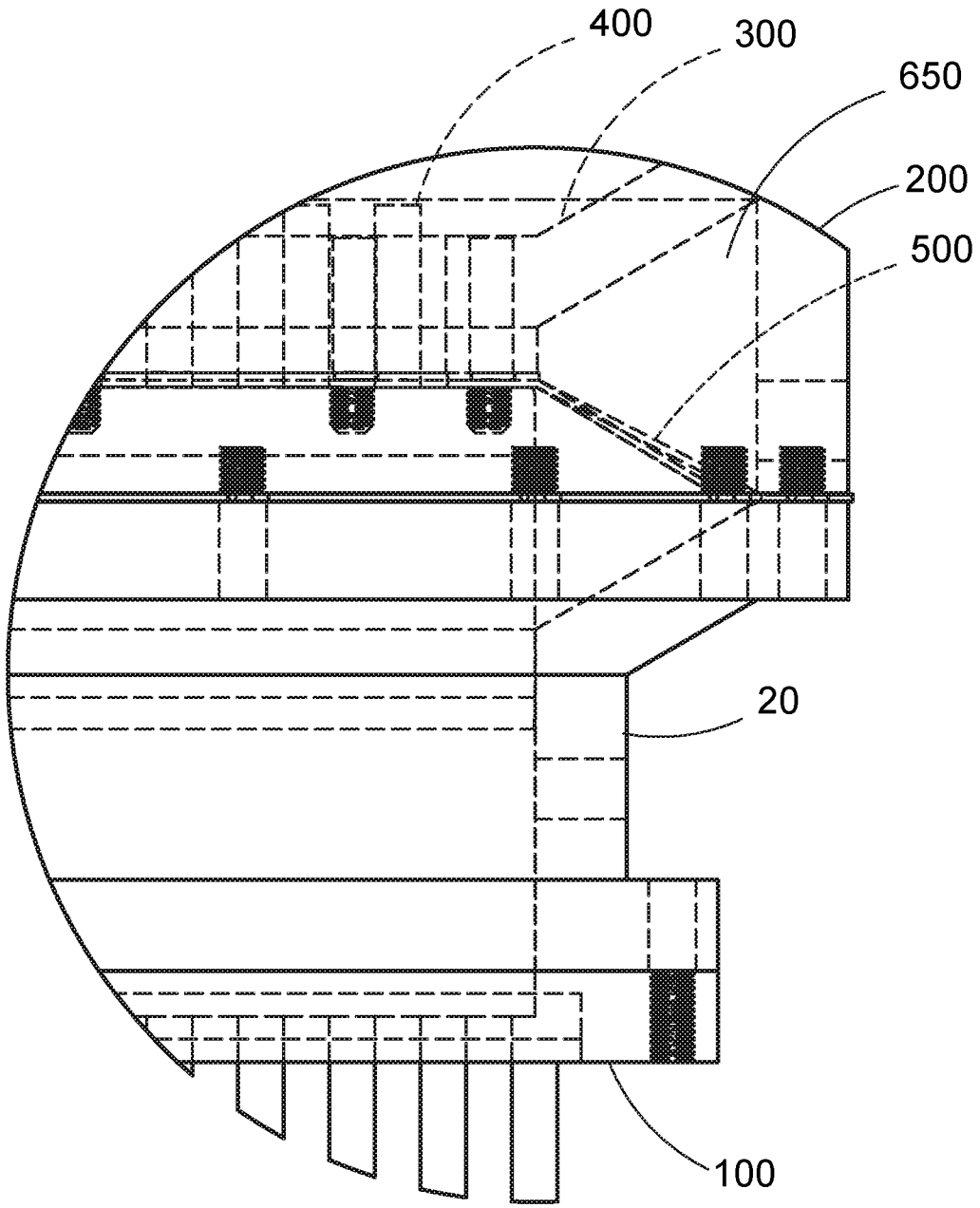
FIG. 12 is a partial side view as seen in Circle 12 in FIG. 4.
Figure 13:
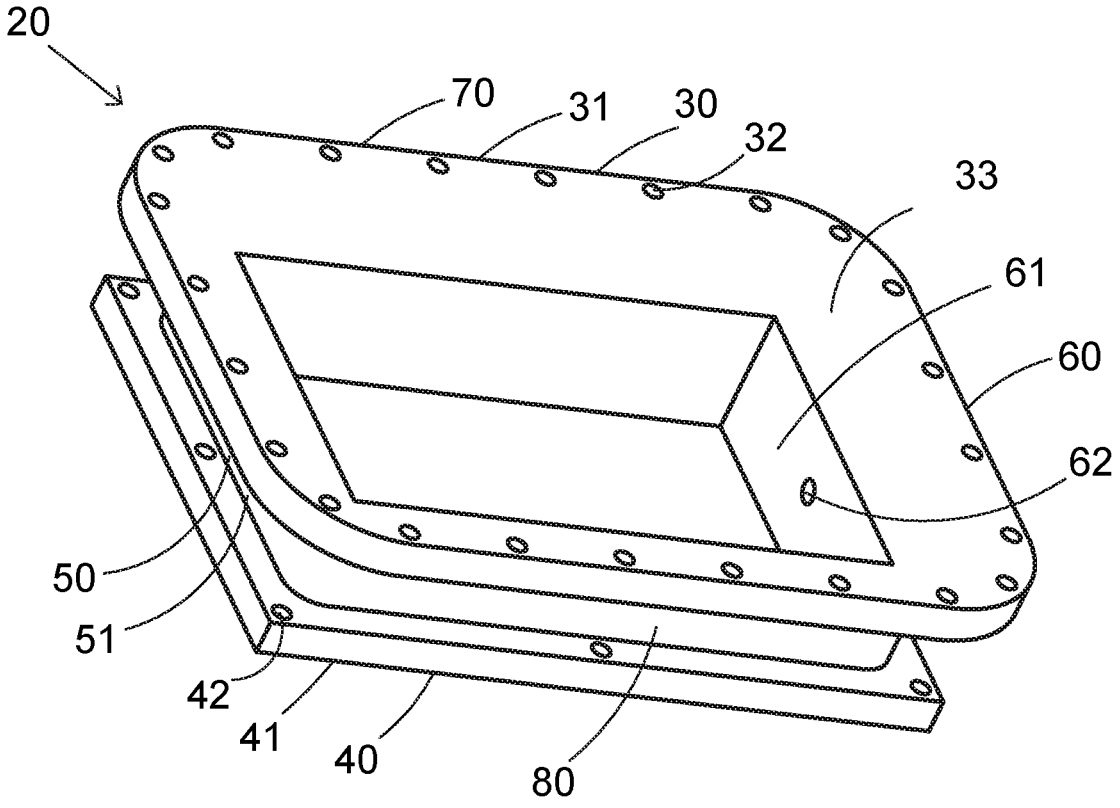
FIG. 13 is a perspective view of a body.
Figure 14:
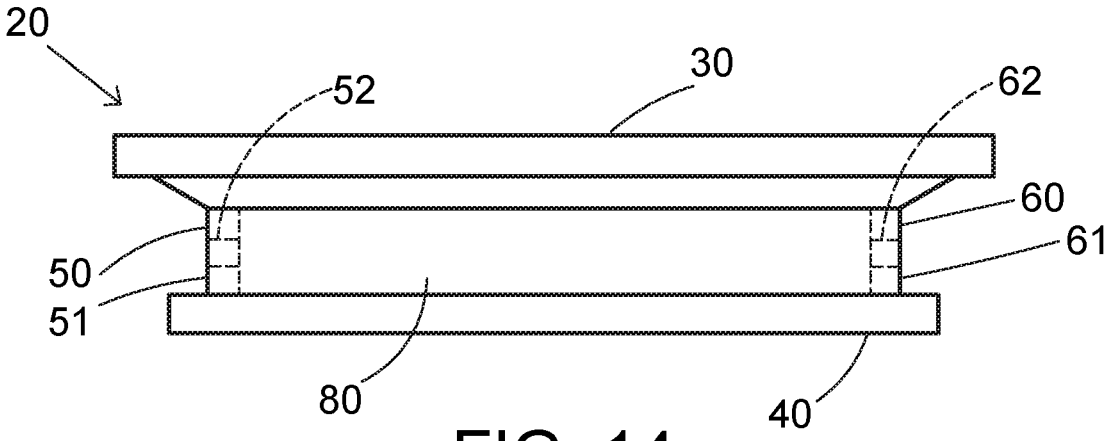
FIG. 14 is a side view of the body illustrated in FIG. 13.
Figure 15:
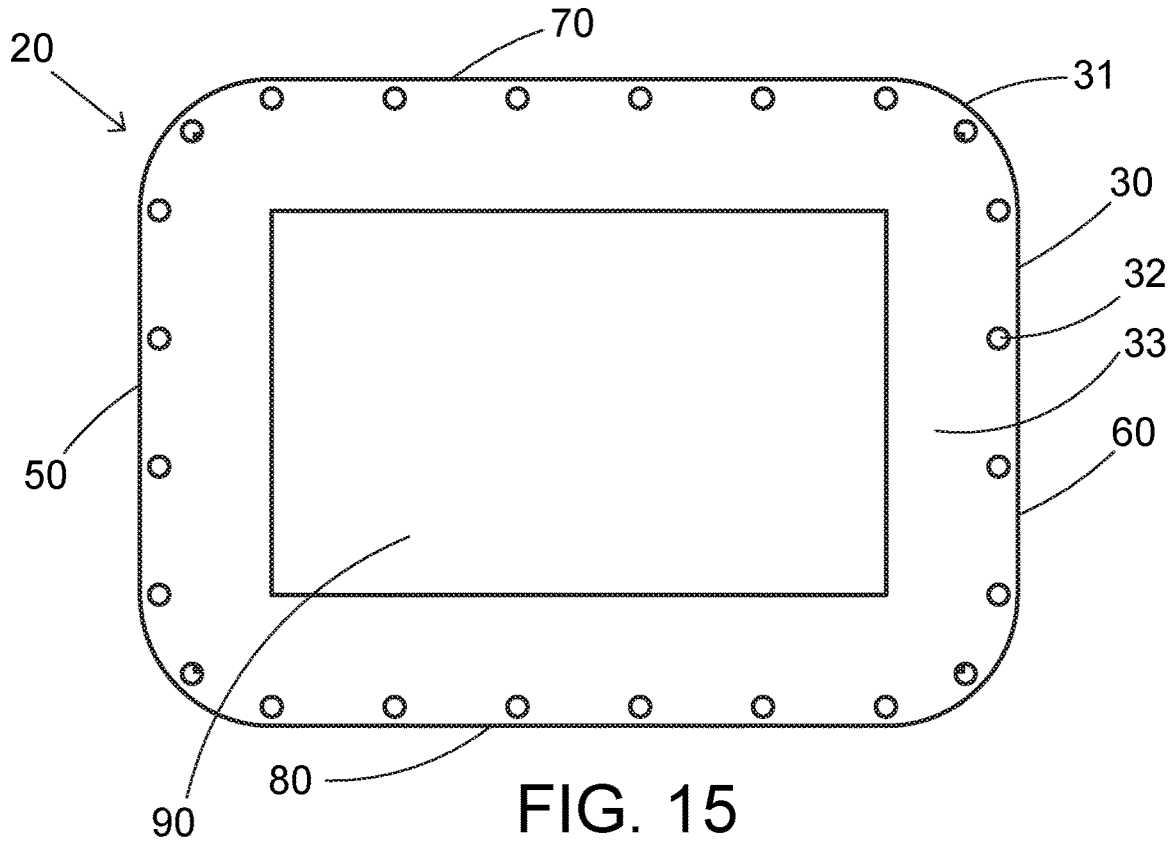
FIG. 15 is a top view of the body illustrated in FIG. 13.
Figure 16:
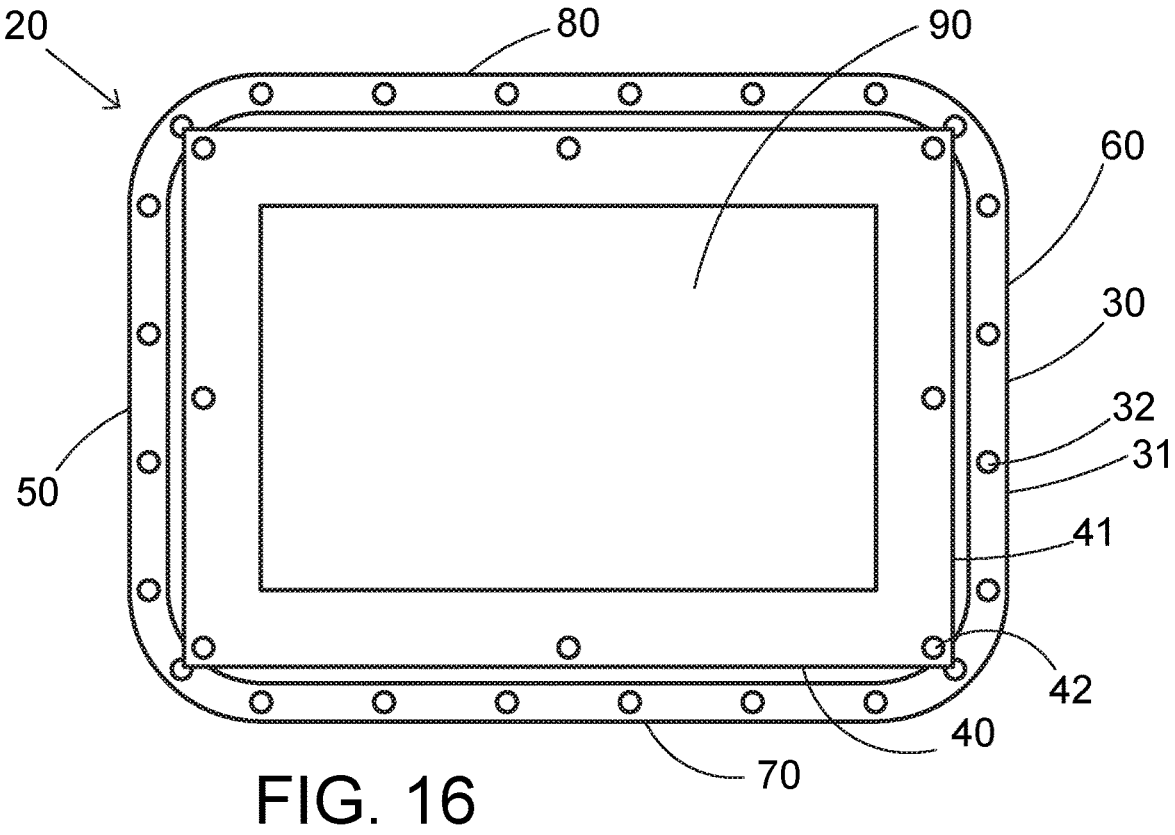
FIG. 16 is a bottom view of the body illustrated in FIG. 13.
Figure 17:
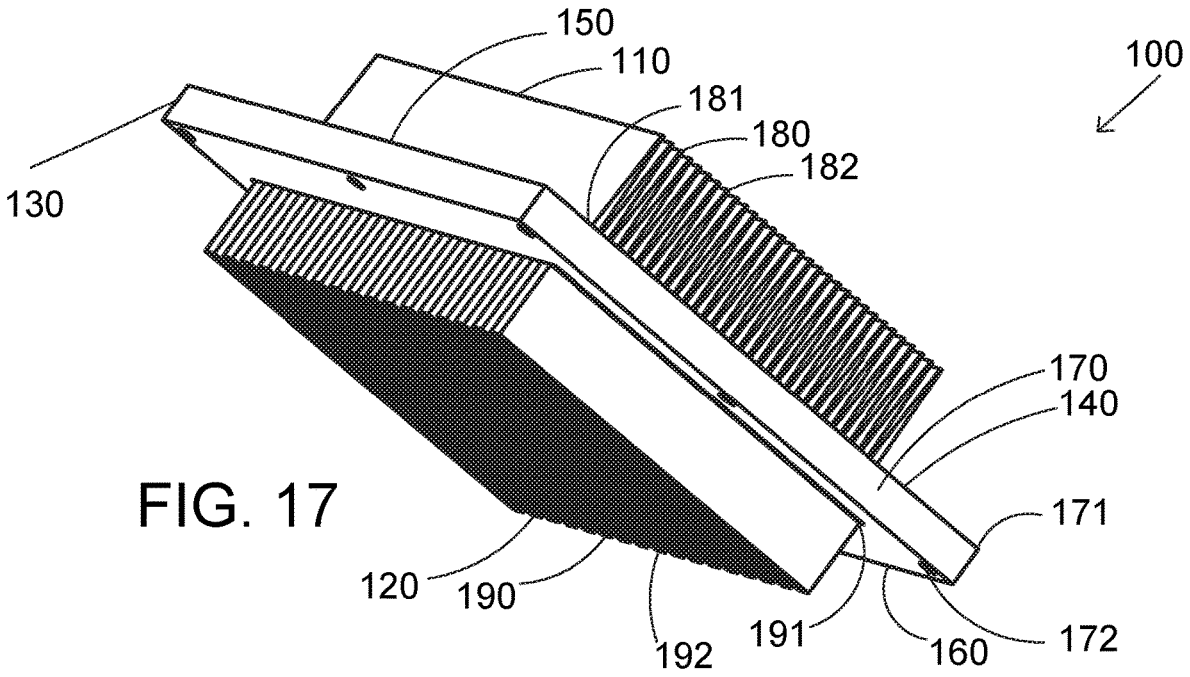
FIG. 17 is a perspective view of a heat sink.
Figure 18:
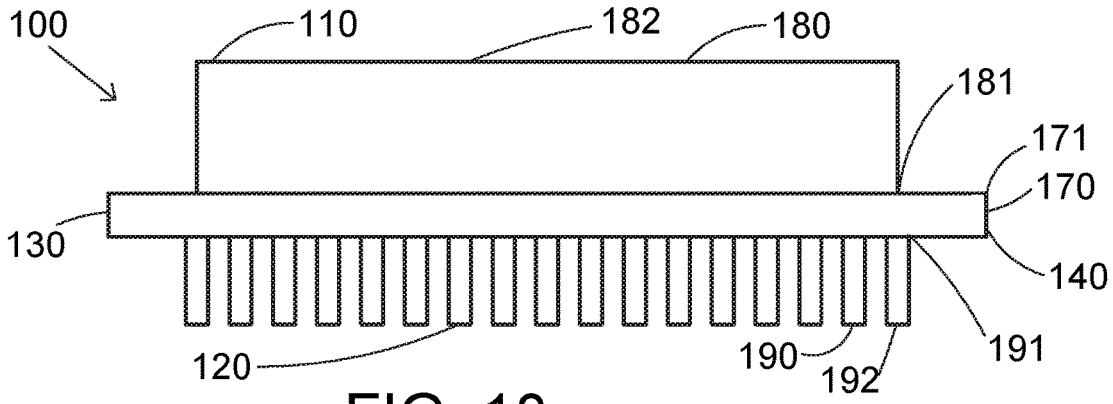
FIG. 18 is a side view of the heat sink illustrated in FIG. 17.
Figure 19:
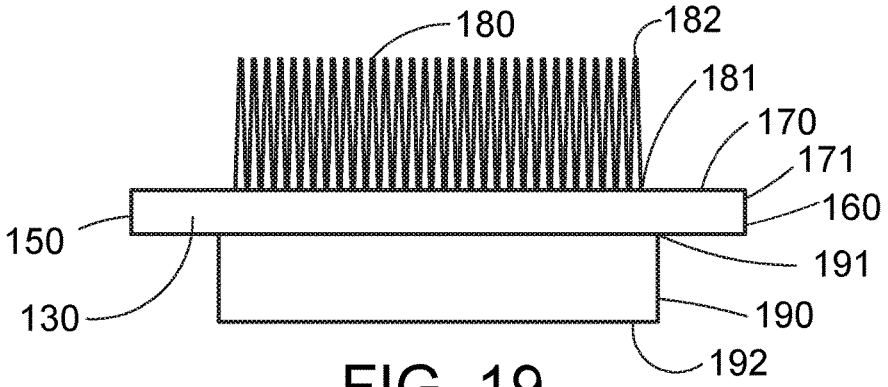
FIG. 19 is an end view of the heat sink illustrated in FIG. 17.
Figure 20:
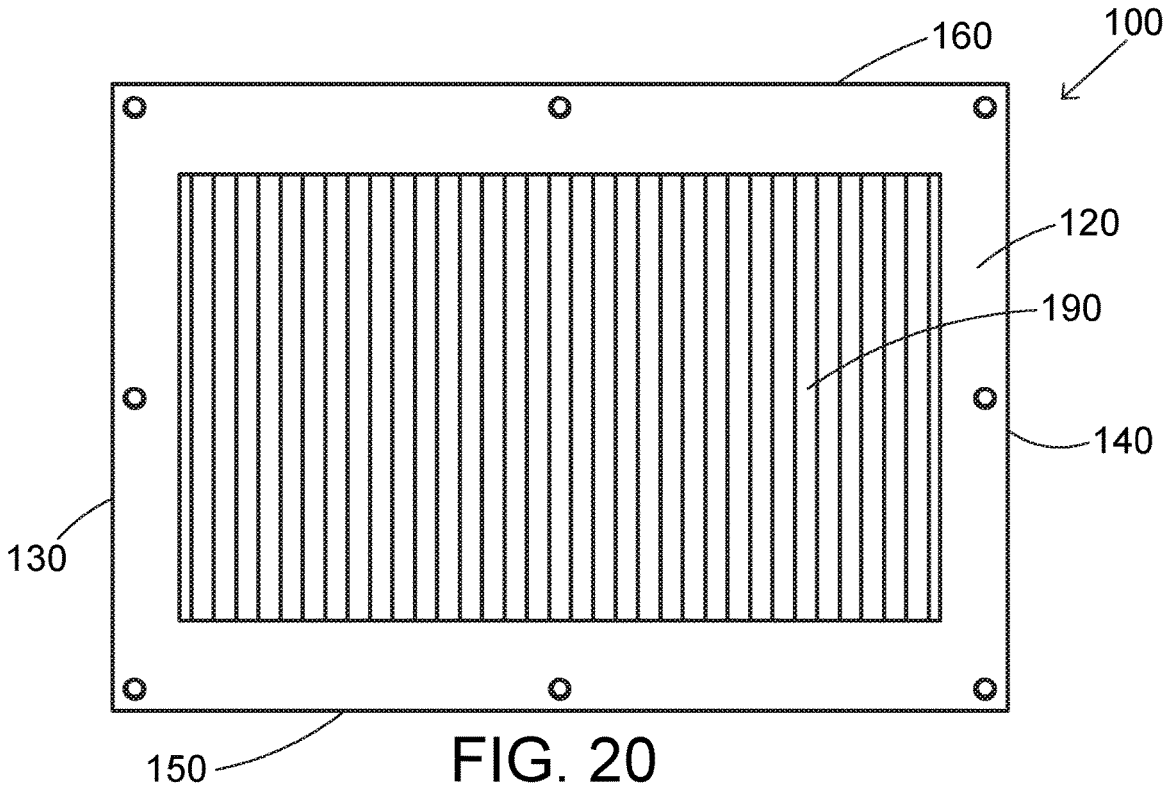
FIG. 20 is a bottom view of the heat sink illustrated in FIG. 17.
Figure 21:
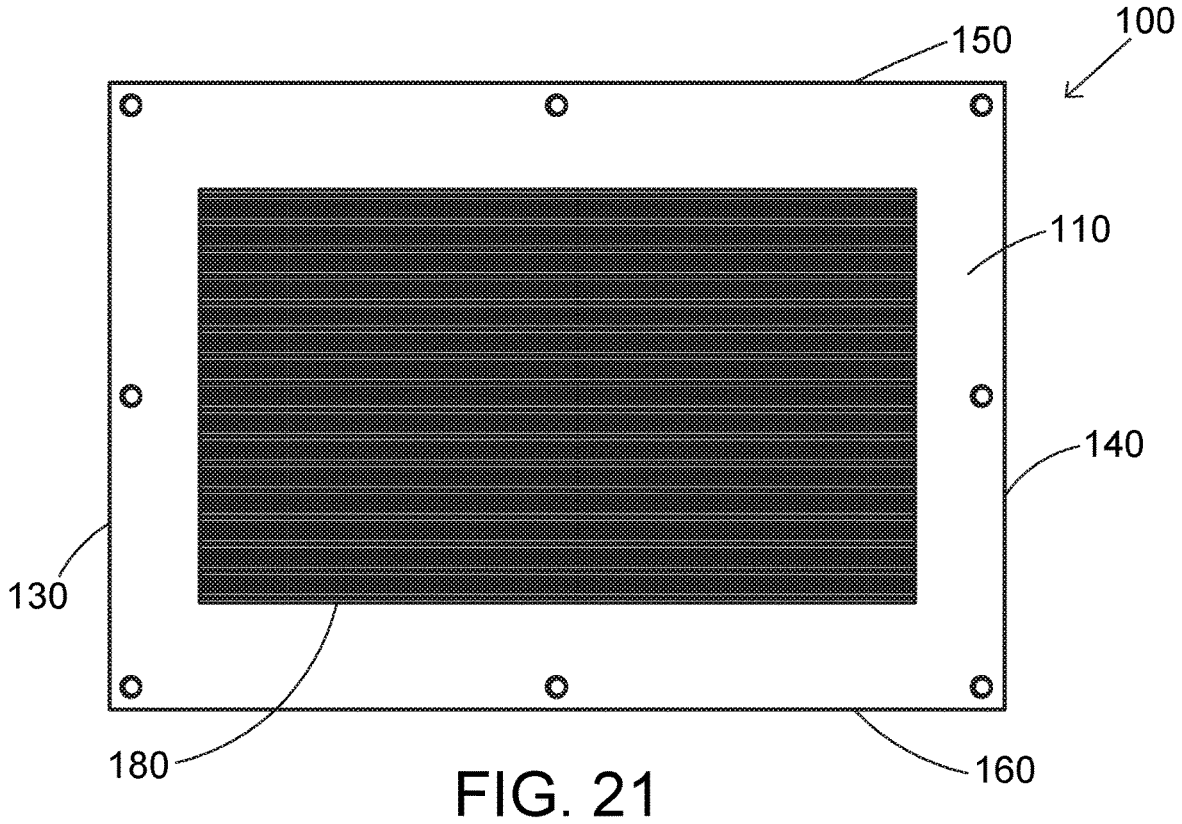
FIG. 21 is a top view of the heat sink illustrated in FIG. 17.
Figure 22:
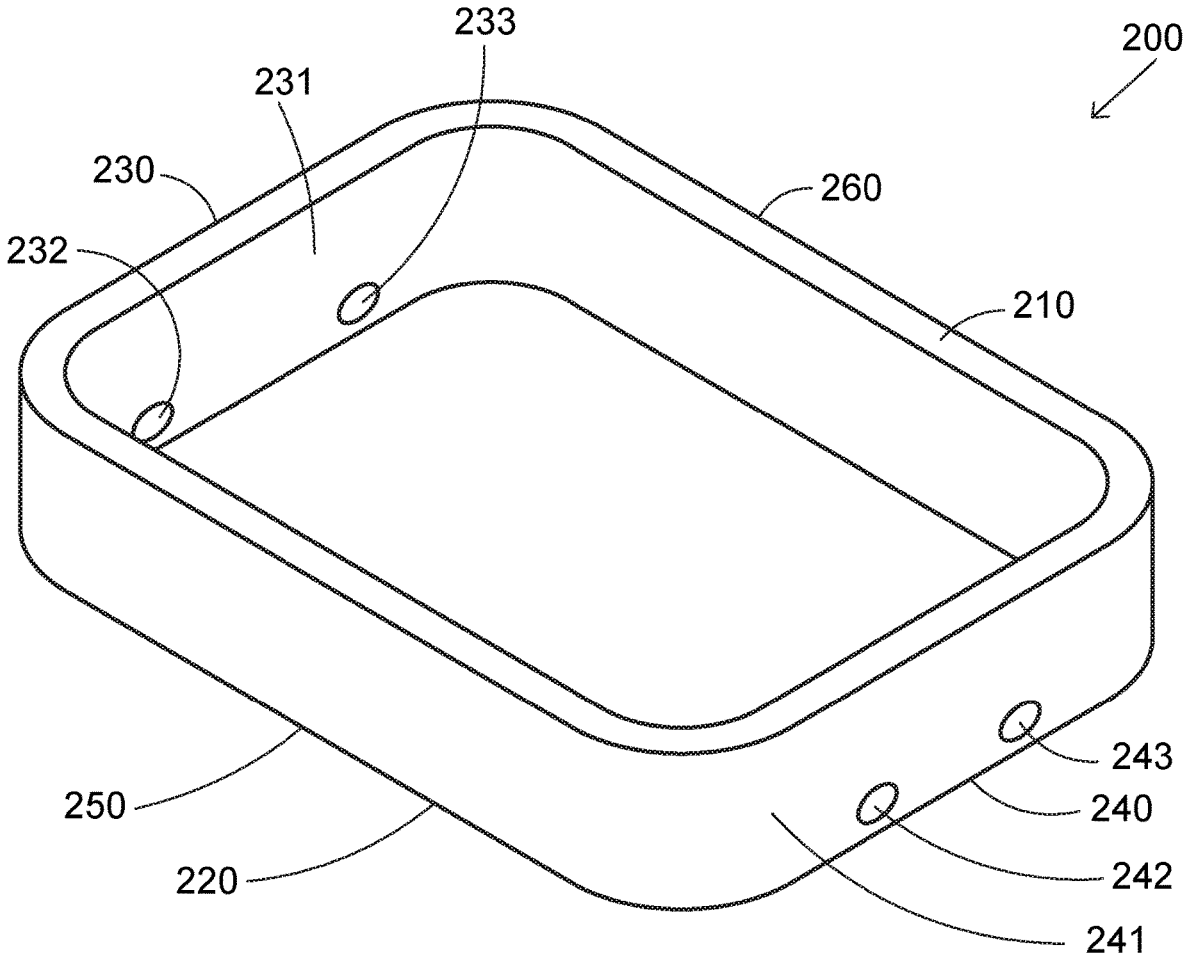
FIG. 22 is a perspective view of an extension.
Figure 23:
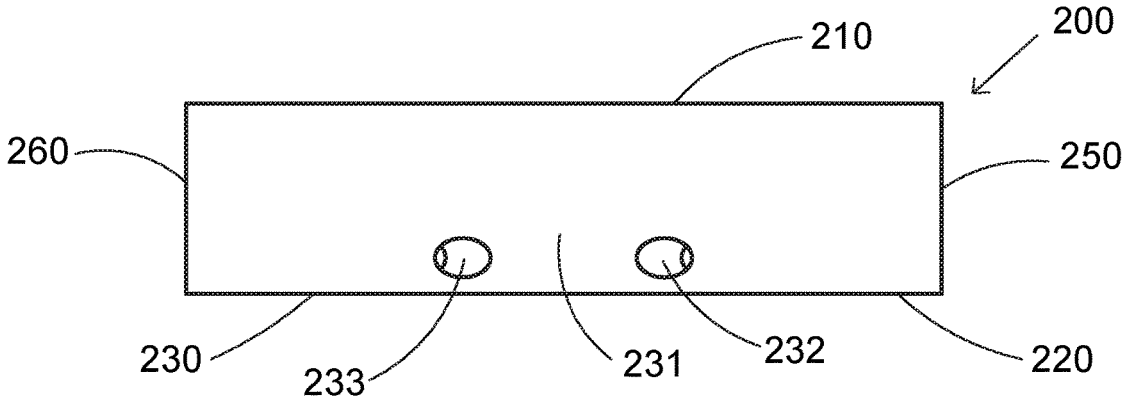
FIG. 23 is an end view of the extension illustrated in FIG. 22.
Figure 24:
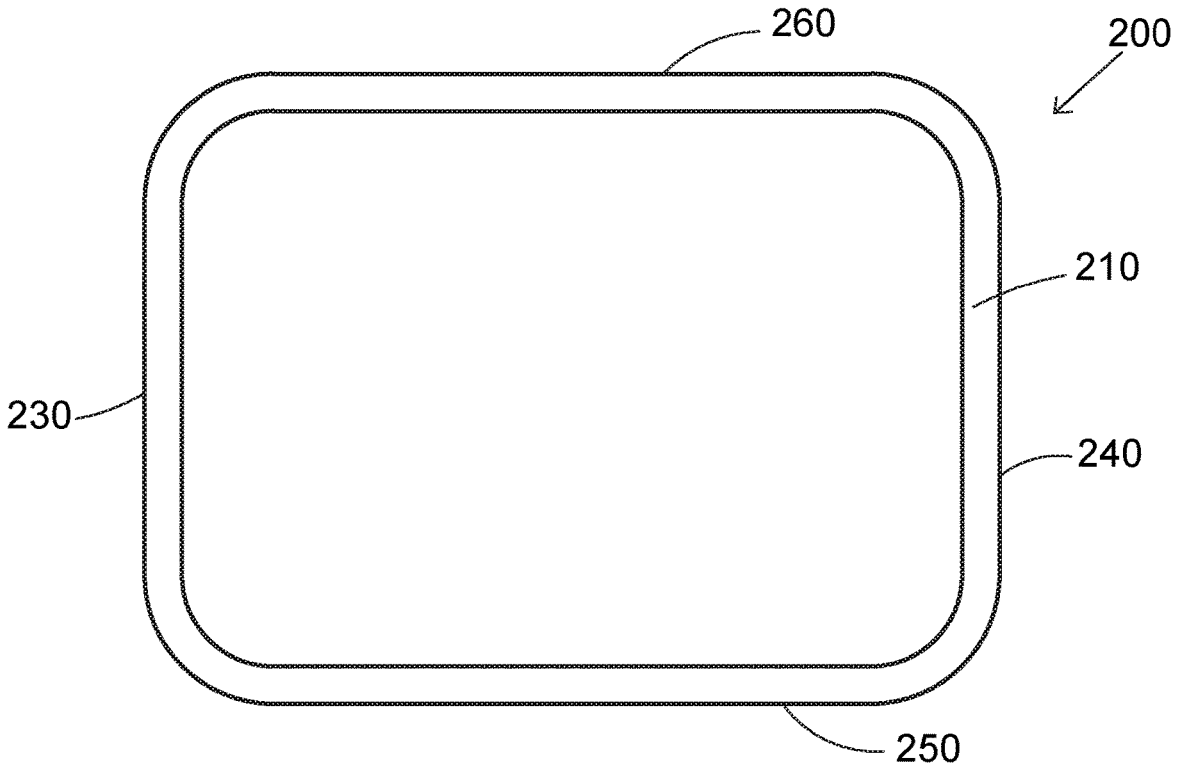
FIG. 24 is a top view of the extension illustrated in FIG. 22.
Figure 25:
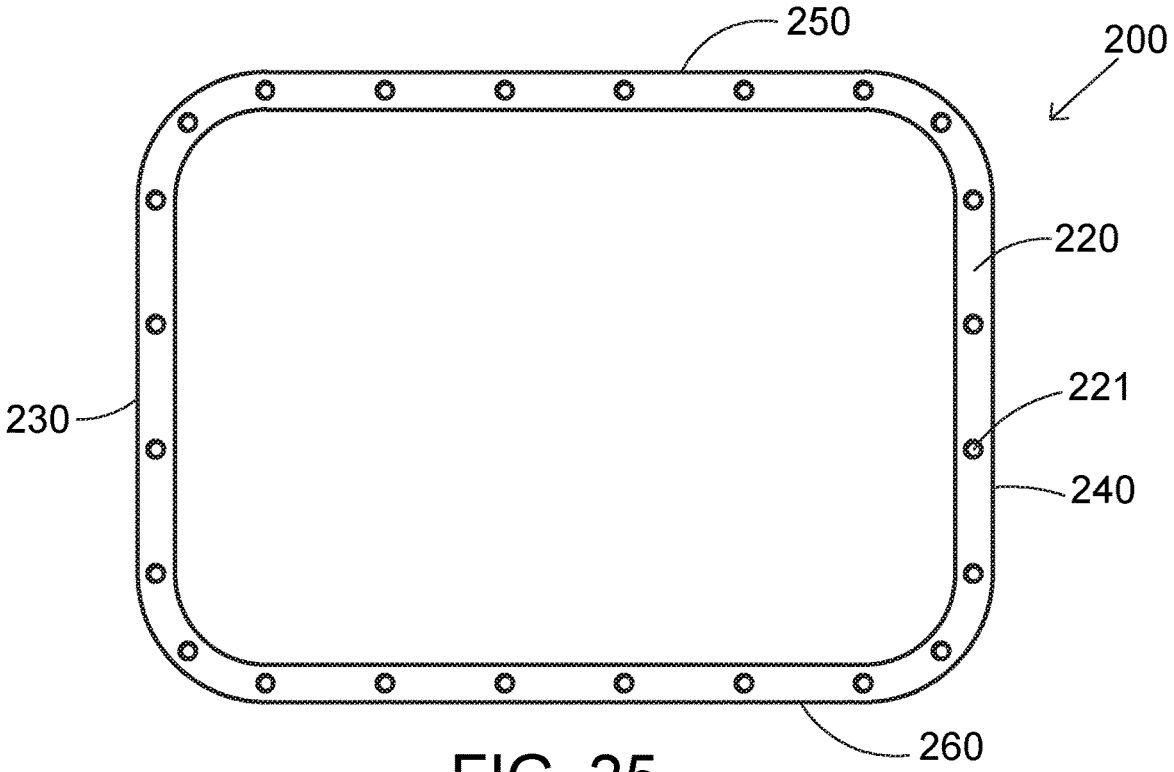
FIG. 25 is a bottom view of the extension illustrated in FIG. 22.
Figure 26:
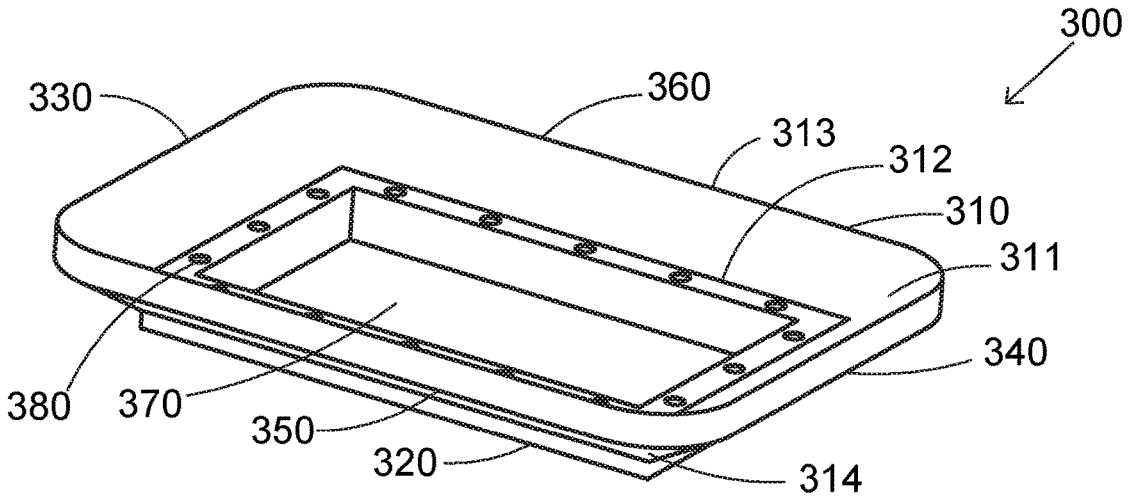
FIG. 26 is a perspective view of a guide.
Figure 27:
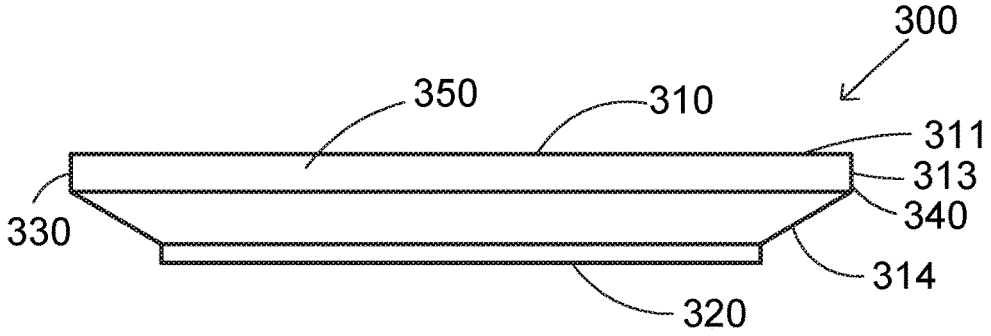
FIG. 27 is a side view of the guide illustrated in FIG. 26.
Figure 28:
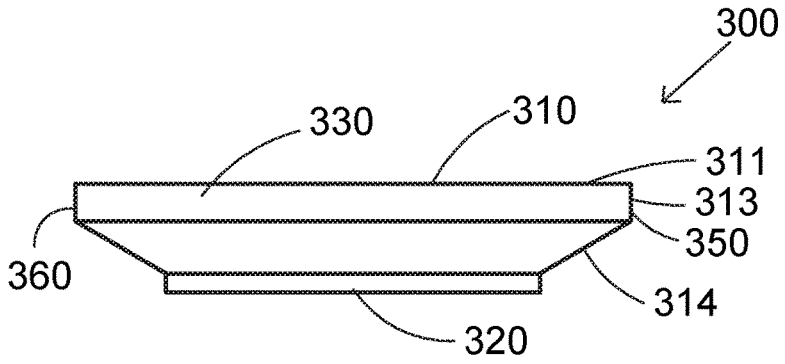
FIG. 28 is an end view of the guide illustrated in FIG. 26.
Figure 29:
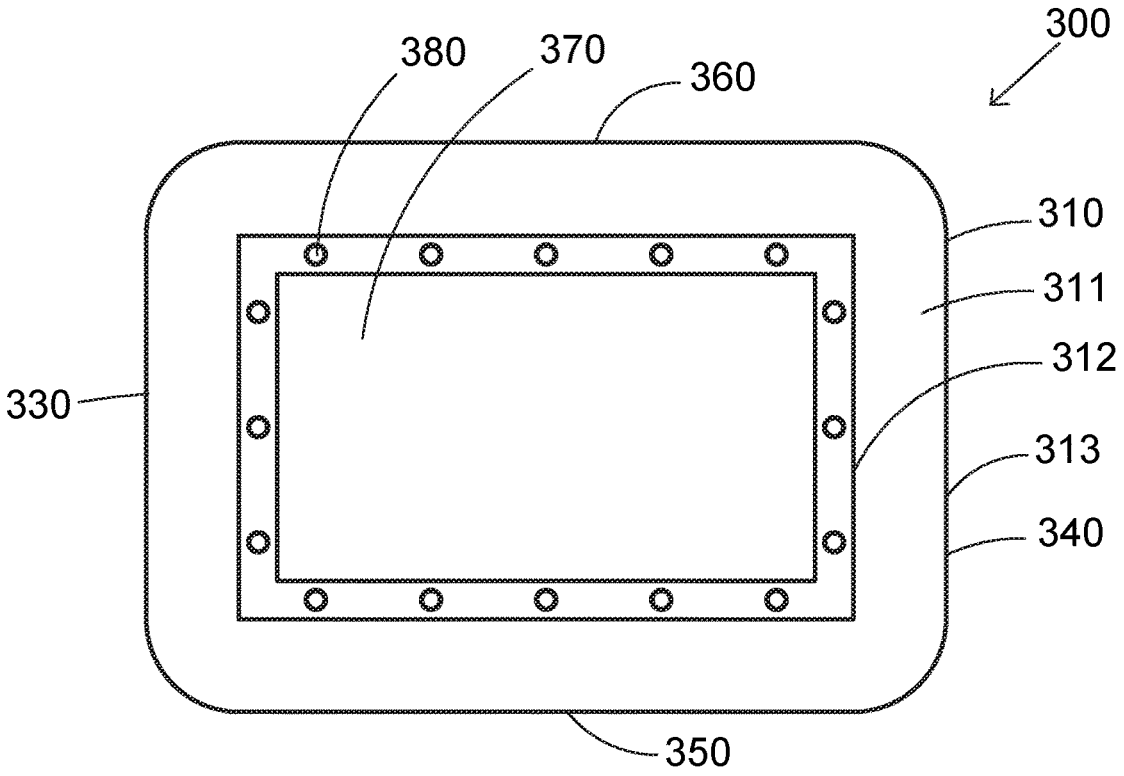
FIG. 29 is a top view of the guide illustrated in FIG. 26.
Figure 30:
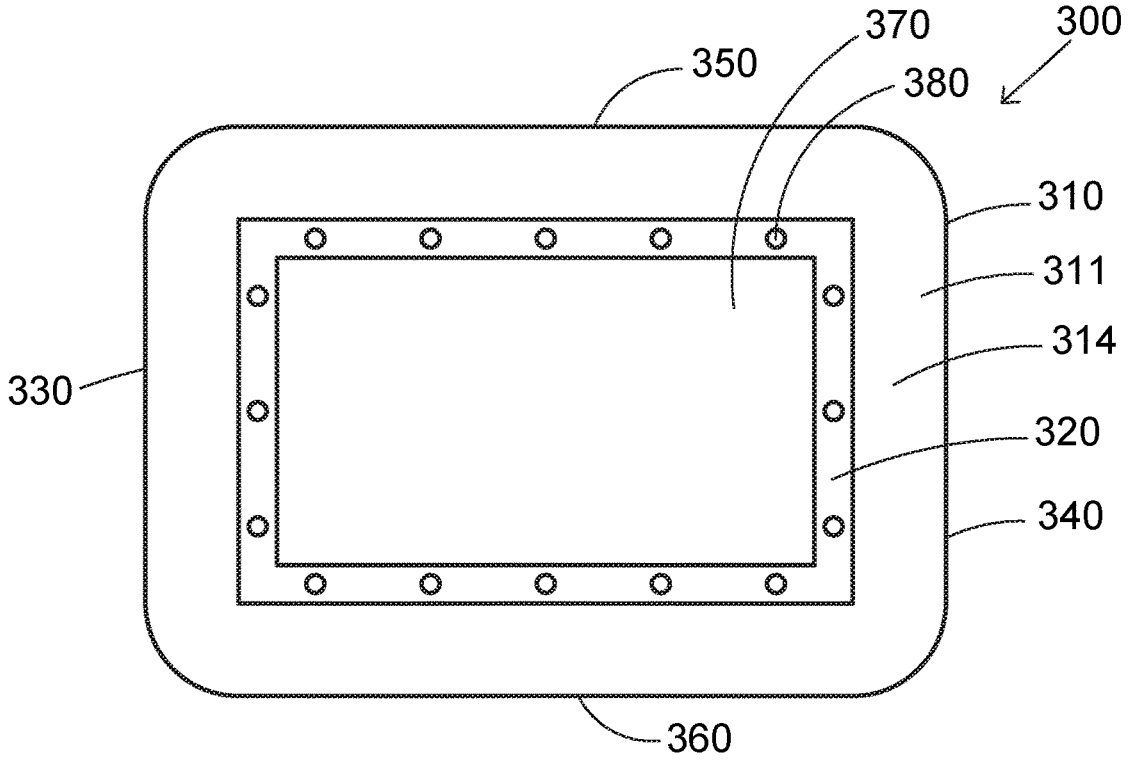
FIG. 30 is a bottom view of the guide illustrated in FIG. 26.
Figure 31:
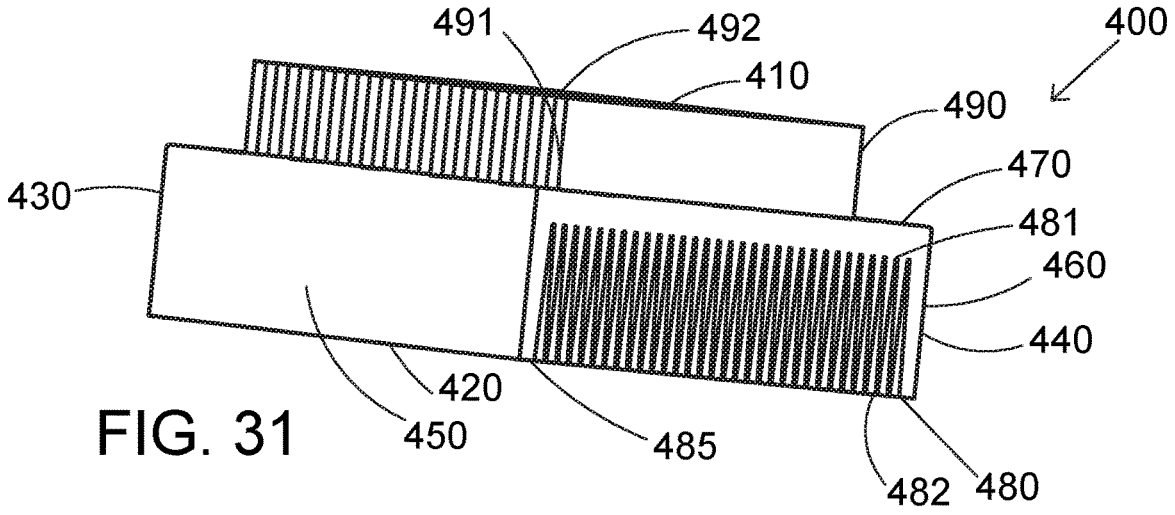
FIG. 31 is a perspective view of a piston.
Figure 32:
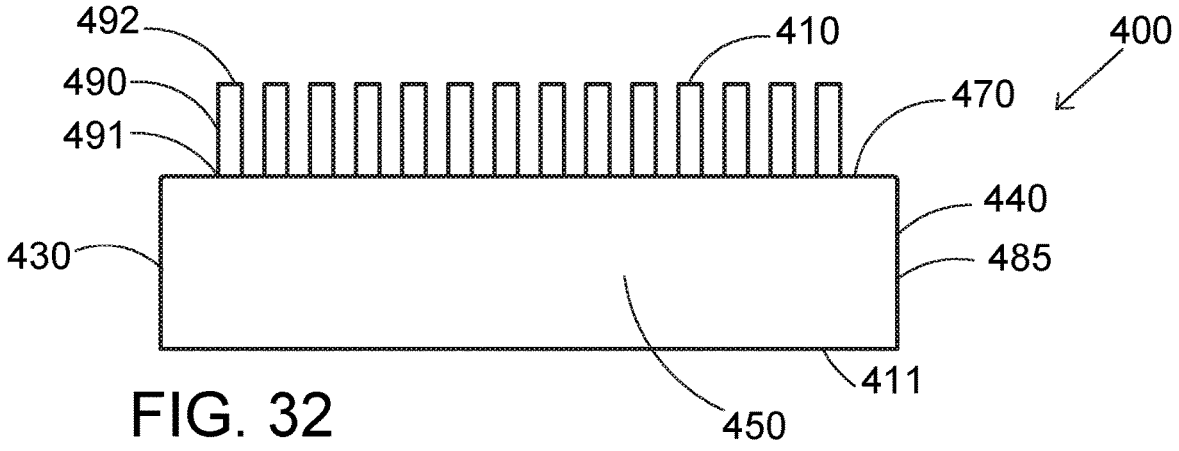
FIG. 32 is a side view of the piston illustrated in FIG. 31.
Figure 33:
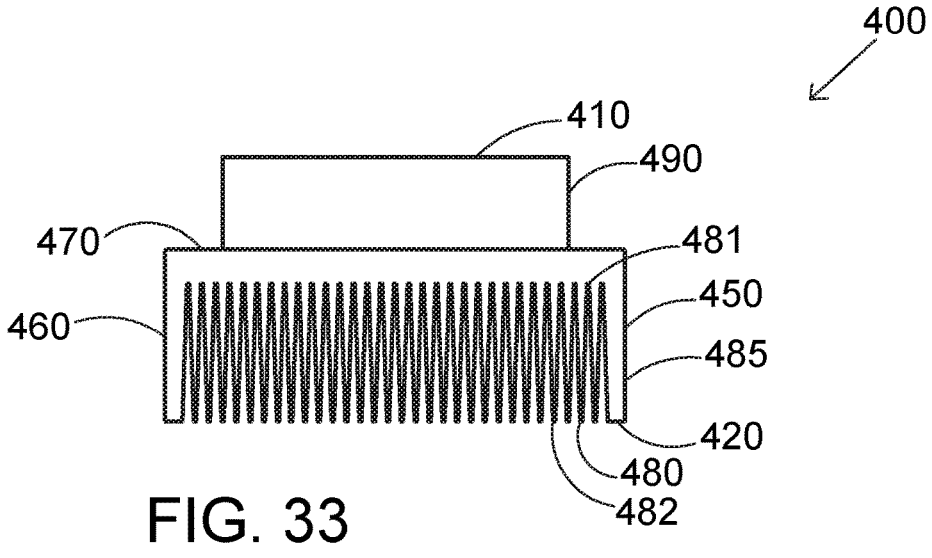
FIG. 33 is an end view of the piston illustrated in FIG. 31.
Figure 34:
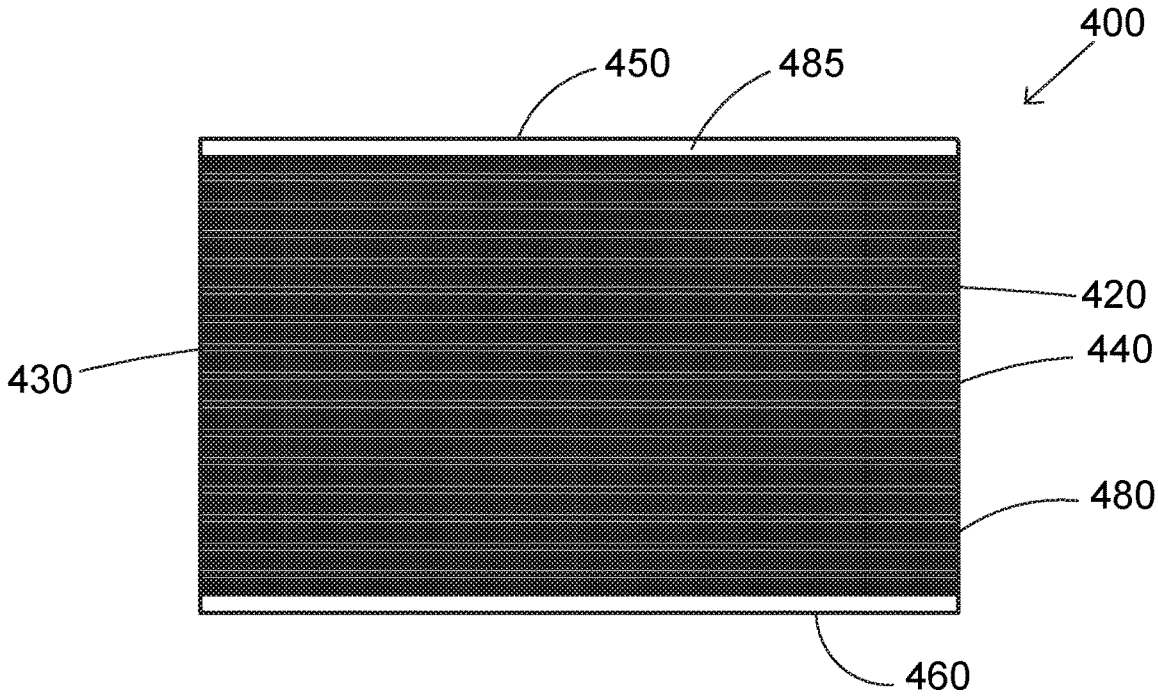
FIG. 34 is a bottom view of the piston illustrated in FIG. 31.
Figure 35:
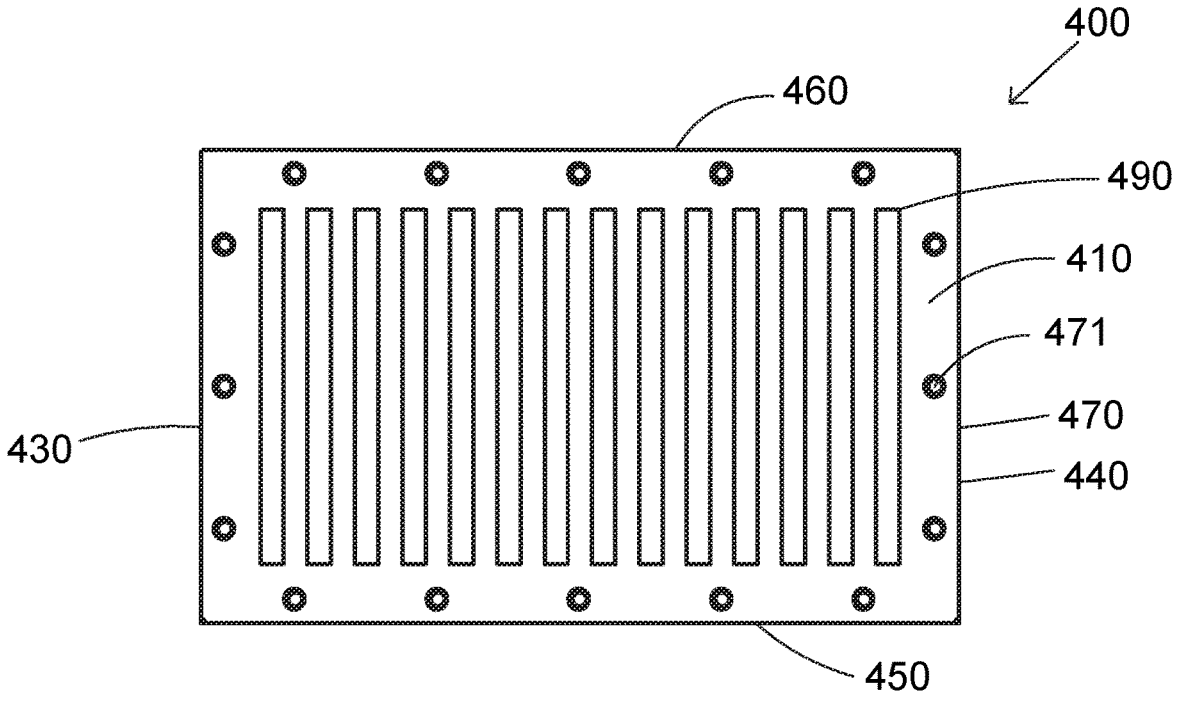
FIG. 35 is a top view of the piston illustrated in FIG. 31.

The pressure equalization system 850 is designed to accommodate changing volumes within the coolant cavity 650 as the piston 400 moves up and down. This change in cavity volume is clearly shown in FIGS. 2, 2A and 2B. The pressure equalization system 850 has an expansion cylinder 855. A pressure equalization piston with a piston head 860 is movably received within the expansion cylinder 855 and separates the heating liquid from the coolant. A high temperature liquid line 865 is provided as is a coolant line 870. The piston head 860 moves up and down within the expansion cylinder 855 in response to the piston 400 moving up and down relative to the body 20 as steam/gas is expanded in the isothermal expansion pump. The location of the piston head 860 within the expansion cylinder 855 is illustrated in FIGS. 2, 2A and 2B in relation to the location of the piston 400 relative to the body 20 in pump 10.

The steam system 900 has a high-pressure reservoir 910 containing both liquid 911 and steam 912. A temperature gauge 920 is provided for measuring the temperature within the reservoir 910. An inlet line 930 (to the pump 10) with a valve 935 is provided. An outlet line 940 (from the pump 10) with a valve 945 is also provided. The steam system has a heat exchanger 950 with a fan 951 that removes heat Q from the steam causing condensation in a liquid return line 960. A liquid pump 970 forces the liquid to return to the reservoir 910. A gas inlet line 980 delivers gas to a burner 995. A valve 990 opens when the burner 995 is turned on so that the burner can supply heat to the reservoir to create high pressure gas/steam.

The control system 1000 has a processor 1010. Several electric lines are provided. Line 1020 is an electric line to the gas valve 990 and burner 995 for the high-pressure reservoir 910. Line 1030 is an electric line to the temperature gauge 920 measuring the temperature within the high-pressure reservoir 910. Line 1040 is an electric line controlling steam inlet valve 935. Line 1050 is an electric line controlling steam outlet valve 945. Line 1060 is an electric line to temperature gauge 755 of the high temperature liquid system 750. Line 1070 is an electric line to the gas valve 765 and burner 770 of the high temperature liquid system 750.

When the system is in operation, the processor can be programmed to operate the system at different temperatures and pressures. The processor will allow for the opening and closing of valves on both the inlet and outlet side of the pump thereby allowing a high pressure gas (which could be steam) to enter the pump, expand in volume and exit at a lower pressure. Work can be extracted from the system in the process. Further, the processor will operate the heating units that will add heat Q to the system and maintain designated temperatures throughout the operating cycle.

One example of a cycle (data illustrated in FIGS. 42 and 43) would start with water as a saturated liquid at P1=1 bar and T1=99.67° C., a pump increases the pressure and temperature to P2=39.67 bar and T2=250° C., as a saturated liquid, requiring inputs of about W12=5 kJ/kg of work and Q12=660 kJ/kg of heat transfer. Phase change occurs in a boiler at constant pressure and temperature, requiring Q23=1715 kJ/kg of heat transfer with a work output of W23=−194 kJ/kg, resulting in a saturated vapor. This is followed by an isothermal expansion process (process 3-4) in the superheated region, from P3=39.67 bar to P4=1 bar, requiring Q34=1026 kJ/kg of heat input and producing W34=−894 kJ/kg of work. A condenser at 1 bar rejects Q41=−2557 kJ/kg of heat, requiring W41=241 kJ/kg work input, returning the water to saturated liquid at 1 bar (state 1). The thermodynamic efficiency of Cycle A is 24.8%. In this example, by having the waste heat rejected at 250 C, the waste heat (2557 KJ/kg) can be utilized to heat a building, a water tank or for a number of other purposes.

Turning now to FIGS. 37-39, it is seen that an alternative pump 1110 is illustrated. Pump 1110 has a body 1120 and a heat sink 1130. The pump 1110 also has an extension 1200 with a top 1210, bottom 1220, an end 1230, an end 1240 and opposed sides 1250 and 1260. End 1230 has a wall 1231 with a coolant inlet 1232 that has one entrance and is split into two exits to split coolant flow. End 1240 has a wall 1241 with a coolant outlet 1242 with two entrances and one exit to combine coolant flow. The pump further has a guide 1300 and a piston 1310. Pump 1110 operates similar to pump 10 with the difference being the coolant flow is split into two portions inside the extension walls as opposed to exterior of the extension.

Figure 40:
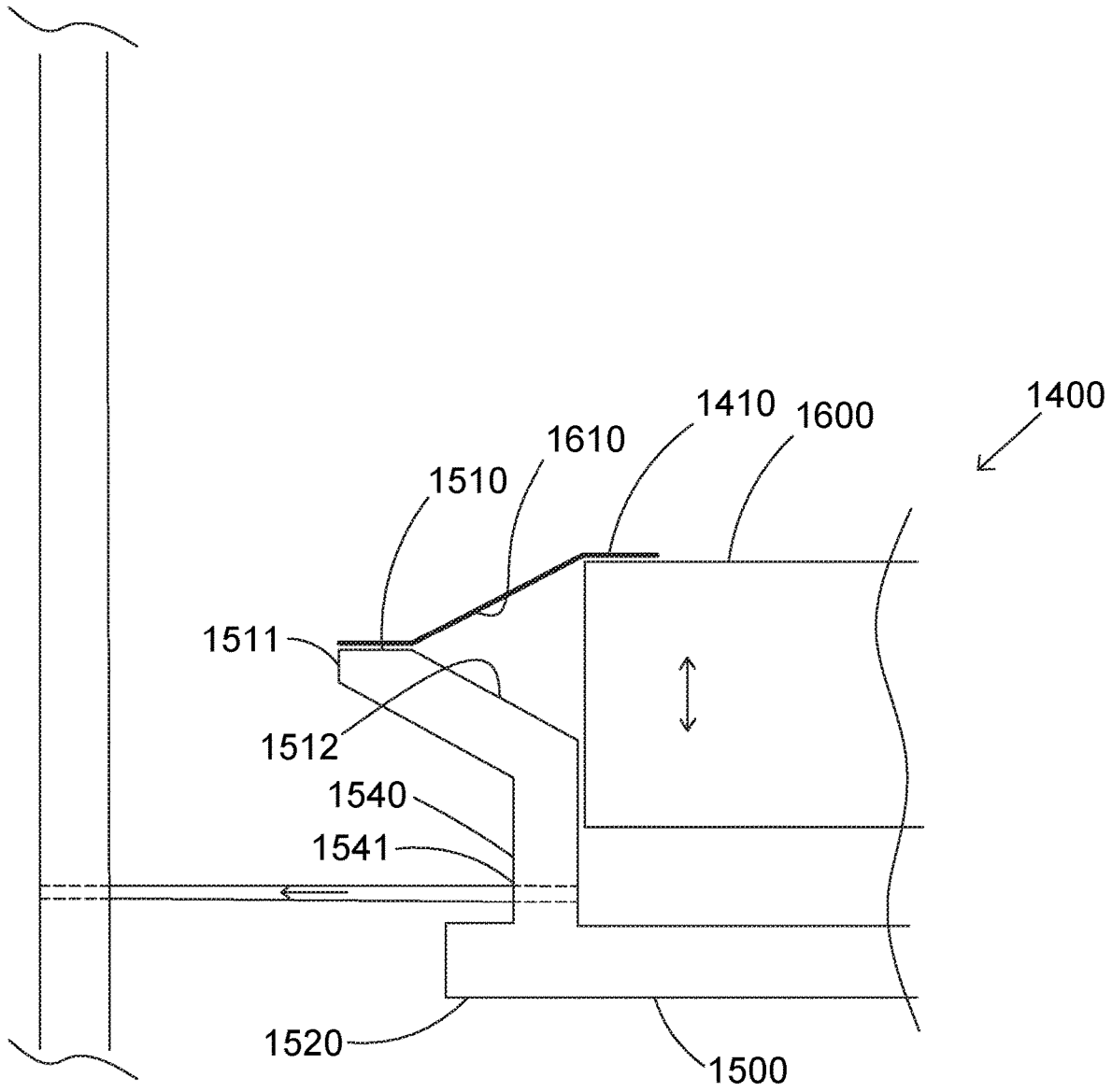
FIG. 40 is a close-up parting schematic of an alternative pump design without a coolant liquid path.

Turning now to FIG. 40, it is seen that an alternative system assembly 1400 is illustrated having a pump 1410. The pump 1410 has a body 1500 with a top 1510 having a perimeter 1511 with an angled face 1512. The body 1500 also has a bottom 1520, an end with an inlet (not shown), an end 1540 with an outlet 1541. The pump 1410 further has a piston 1600 and a bladder 1610. In this alternative embodiment, there is no coolant cavity. The bladder 1610, which separates the heating liquid from the gas, is directly in contact with the heating liquid which leads to a rapid degradation of the bladder. The other option for maintaining bladder integrity would be to reduce the temperature of the heating liquid which in turn would reduce thermodynamic efficiency.

Figure 41:
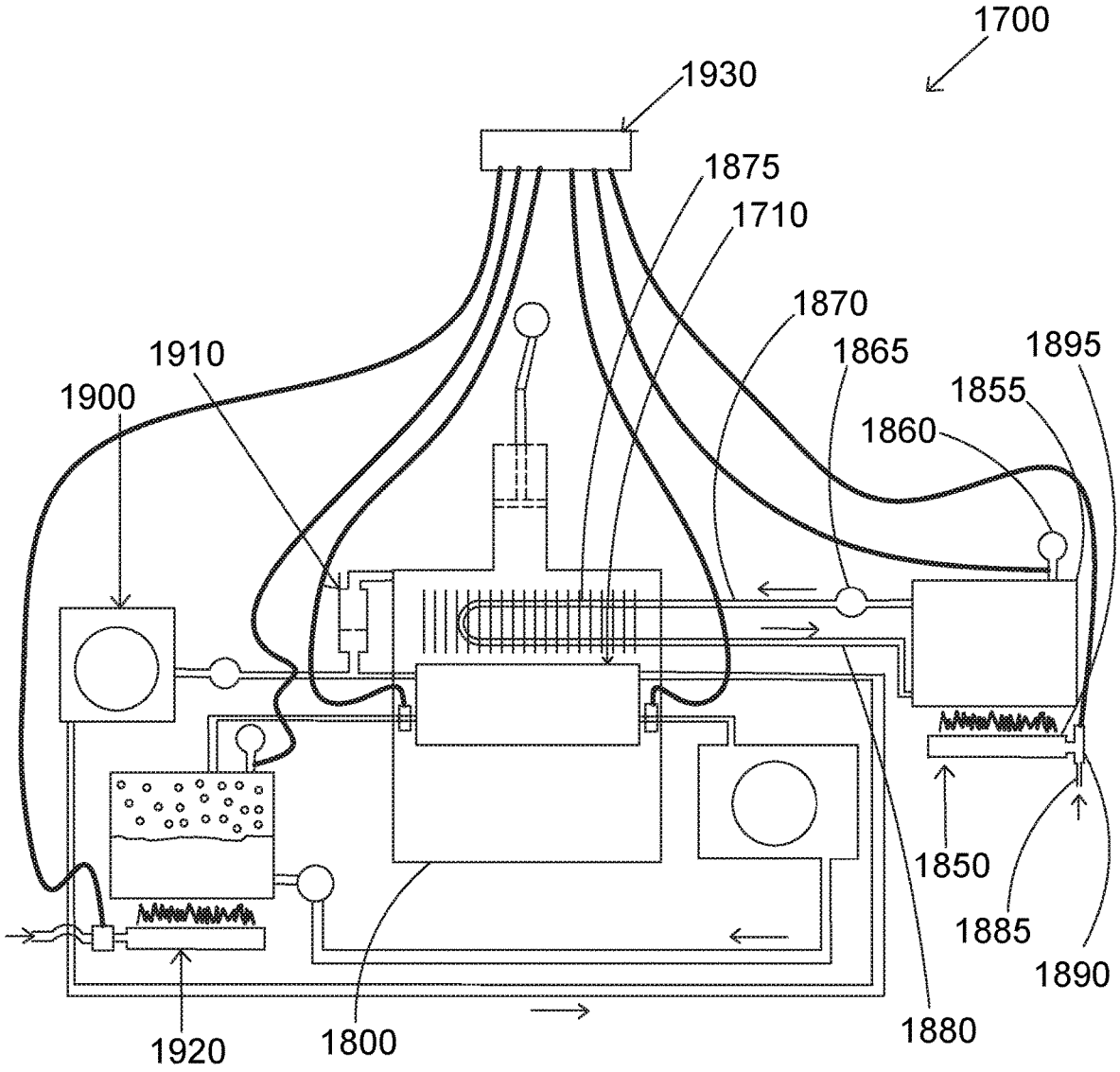
FIG. 41 is a schematic view of an alternative system assembly incorporating an isothermal pump.

Now, tuning to FIG. 41, it is seen that an alternative system assembly 1700 is illustrated. The system assembly 1700 has a pump 1710 (can be the same as pump 10), a tank 1800, a high temperature liquid system 1850, a coolant system 1900, a pressure equalization system 1910, a steam system 1920 and a control system 1930.

The difference in this embodiment relates to the high temperature liquid system 1850. The high temperature liquid system 1850 has a reservoir 1855, a temperature gauge 1860, an inlet line 1870, a heat exchanger 1875, a return line 1880, a gas inlet line 1885, a gas valve 1890 and a burner 1895. The pump 1865 routes heated liquid through the heat exchanger 1875 that is located inside the tank 1800. The burner adds heat Q to the high temperature liquid system and pump 1865 routes heated liquid through the heat exchanger 1875 that is located inside the tank 1800.

Thus, it is apparent that there has been provided, in accordance with the invention, an isothermal pump that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. An expansion device for expanding a gas, said expansion device comprising:

a body having a gas inlet and a gas outlet;

an extension, said extension fixed in position with respect to said body;

a guide movable with respect to the extension;

a piston, said piston fixed in position with respect to said guide;

a bladder having an inner perimeter and an outer perimeter, said outer perimeter being between said body and said extension, and said inner perimeter is between said guide and said piston, said bladder separating a coolant within a coolant cavity from said gas within a gas cavity, wherein said coolant cools said bladder; and a heat sink connected to said body, wherein:

said heat sink has heat sink interior transfer fins in said gas cavity and heat sink exterior transfer fins exterior of said gas cavity; and said piston has piston interior transfer fins in said gas cavity and piston exterior transfer fins exterior of said gas cavity.

2. The expansion device of claim 1, wherein said guide is movable with respect to said extension to determine the size of said gas cavity within said expansion device.

3. The expansion device of claim 1 wherein said coolant cavity is bordered by said bladder, said guide and said extension.

4. The expansion device of claim 1, wherein said coolant enters and exits said coolant cavity through said extension.

5. The expansion device of claim 4, wherein said extension has a first end wall lying in a first end wall plane, and a second end wall lying in a second end wall plane, two coolant inlets through said first end wall and being oriented between perpendicular and parallel to said first end wall plane, and two coolant outlets through said second end wall and being oriented between perpendicular and parallel to said second end wall plane.

6. An expansion device housed within a tank containing heating liquid, said expansion device comprising:

a body having a gas inlet and a gas outlet;

a piston movable with respect to said body;

a gas cavity;

a coolant cavity; and a bladder separating said gas cavity from said coolant cavity, wherein said bladder has a maximum operable temperature and a coolant flows through said coolant cavity to keep said bladder below said maximum operable temperature.

7. The expansion device of claim 6 further comprising:

an extension, said extension fixed in position with said body; and a guide in a fixed position with respect to said piston, said guide being movable with respect to said extension.

8. The expansion device of claim 7, wherein said coolant cavity is bordered by said bladder, said guide and said extension.

9. The expansion device of claim 8, wherein:

said bladder has an inner perimeter and an outer perimeter;

said outer perimeter is between said body and said extension; and said inner perimeter is between said guide and said piston.

10. The expansion device of claim 7, wherein said coolant enters and exits said coolant cavity through said extension.

11. The expansion device of claim 7, wherein said extension has a first end wall lying in a first end wall plane, and a second end wall lying in a second end wall plane, two coolant inlets through said first end wall and being oriented between perpendicular and parallel to said first end wall plane, and two coolant outlets through said second end wall and being oriented between perpendicular and parallel to said second end wall plane.

12. The expansion device of claim 6 further comprising a heat sink connected to said body, wherein:

said heat sink has heat sink interior transfer fins in said gas cavity and heat sink exterior transfer fins exterior of said gas cavity; and said piston has piston interior transfer fins in said gas cavity and piston exterior transfer fins exterior of said gas cavity.

* * * * *